United States Patent [19]

Takaoka

[11] Patent Number: 5,016,593

[45] Date of Patent: May 21, 1991

[54] METHOD AND APPARATUS FOR PREVENTING SURGING OF VEHICLE HAVING INTERNAL COMBUSTION ENGINE

[75] Inventor: Toshio Takaoka, Toyota, Japan

[73] Assignee: Toyota Jidosha Kabushiki Kaisha, Toyota, Japan

[21] Appl. No.: 516,970

[22] Filed: Apr. 30, 1990

[30] Foreign Application Priority Data

May 1, 1989 [JP] Japan ..... 1-109150
May 1, 1989 [JP] Japan ..... 1-109151

[51] Int. Cl.[5] ..... F02D 41/14
[52] U.S. Cl. ..... 123/436; 364/431.08
[58] Field of Search ..... 123/436, 419; 364/431.08

[56] References Cited

U.S. PATENT DOCUMENTS 4,527,523 7/1985 Dänmer et al. ..... 123/436
4,562,818 1/1986 Kohama et al. ..... 123/478
4,724,813 2/1988 Cinpinski ..... 123/436
4,759,327 7/1988 Nagano et al. ..... 123/436
4,792,902 12/1988 Hrovat et al. ..... 123/419
4,919,098 4/1990 Shimada et al. ..... 123/419
4,928,652 5/1990 Shinya et al. ..... 123/419

FOREIGN PATENT DOCUMENTS 58-38354 3/1983 Japan .
58-160530 9/1983 Japan .
60-27748 2/1985 Japan .
60-27761 2/1985 Japan .
60-125739 7/1985 Japan .

*Primary Examiner*—Andrew M. Dolinar
*Attorney, Agent, or Firm*—Kenyon & Kenyon

[57] ABSTRACT

In an internal combustion engine, a vibration period and a vibration amplitude are measured when the surging of a vehicle is detected and the detected vibration period is compared with a natural vibration period prestored in accordance with a driving condition of the vehicle when the detected vibration amplitude is larger than a predetermined value, and if the detected vibration period is equal to the natural vibration period under the driving condition at which the vibration period is detected, surging due to variations of a combustion cycle of the engine is determined to be occurring, and accordingly, a surging reducing process is activated.

26 Claims, 17 Drawing Sheets

| Fig.4A |
| --- |
| Fig.4B |

408
DT180PRE < 0 ?
SES (NEGATIVE AREA → POSITIVE AREA)
NO (POSITIVE AREA)
409
DT180 > MAX1 ?
YES (INCREASING)
NO (DECREASING)
410
MAX1 ← DT180
t1 ← T
411
RETURN
412
DT180PRE > 0 ?
YES (POSITIVE AREA → NEGATIVE AREA)
NO (NEGATIVE AREA)
413
ARE MAX1, MAX2, AND MIN STORED ?
YES
NO
414
Φ ← t2 - t1
A ← MAX1 - MIN
415
IS MAX1 STORED ?
YES
NO
416
MAX2 ← MAX1
t2 ← t1
417
RESETTING MAX1 AND MIN
418
DT180 < MIN ?
YES (DECREASING)
NO (INCREASING)
419
MIN ← DT180
420
RETURN

Φ AND A CAL. ROUTINE
TM ← TM + 1
400
TM = 6 ?
401
NO
YES
402
RETURN
TM ← 0
403
TPRE ← T
T1804 ← T1803
T1803 ← T1802
T1802 ← T1801
DT720PRE ← DT720
501
T1801 ← TPRE - T
502
T720 = Σ T180i
503
DT720 ← T720 - T720PRE
T720PRE ← T720
504
DT720 > L1 ?
505
NO
DT720 < L2 ?
510
NO
YES
DT720 ≧ L2

| Fig.9A |
| --- |
| Fig.9B |

| Fig.12A |
| --- |
| Fig.12B |

METHOD AND APPARATUS FOR PREVENTING SURGING OF VEHICLE HAVING INTERNAL COMBUSTION ENGINE

BACKGROUND OF THE INVENTION

1. Field of the Invention

The present invention relates to a method and apparatus for preventing a surging of a vehicle having an internal combustion engine. Such a surging is often due to variations in a cycle-to-cycle combustion in an internal combustion engine.

2. Description of the Related Art

Generally, a vehicle having an internal combustion engine is driven by the torque generated by the internal combustion engine, and when the torque is intermittently lost or an negative torque is generated by a misfiring of the internal combustion engine, the vehicle is affected by a negative acceleration force. A repetition of such a negative acceleration force causes a longtitudinal vibration of the vehicle, i.e., surging, and passengers in the vehicle suffer discomfort. Therefore, it is desirable to reduce the surging of a vehicle due to variations in the combustion cycle of the internal combustion engine.

Unexamined Japanese Patent application No. 58-160530 discloses a method of controlling the torque of the internal combustion engine to reduce variations in the torque by detecting these torque variations. In this method, torque variations are detected by at least one driving parameter of the engine such as a variation of the rotational speed of the engine, a longtitudinal acceleration of the vehicle, a variations of the combustion pressure of the engine, or a torsion angle of a transmission axis of the engine, and the detected torque variation is limited by a filter allowing the passage of specific vibration frequencies having bodily affects. Accordingly, in this method, vibration frequencies having a bad effect on the human body are selected by the filter from among the variety of longtitudinal vibration frequencies of the vehicle, and in accordance with the detection of such vibration frequencies, variations of the torque of the engine are determined to have occurred and the torque of the enguine is then controlled to reduce the detected torque variations.

Nevertheless, when the vehicle is traveling on a rough road surface, the roughness of the road surface is picked up by the tires of the vehicle as a vibration, and this vibration may cause the vehicle to vibrate longtitudinally; which longtitudinal vibration may be erroneously detected as surging according to th the method disclosed in Unexamined Japanese Patent application No. 58-160530. Namely, in this method, if the frequency of the longtitudinal vibration caused by the vehicle traveling on a rough road surface contains frequencies of 1 to 10 Hz, which agrees with specific vibration frequencies having bodily affects, these frequencies of 1 to 10 Hz are attributed to surging caused by variations of the combustion cycle of the engine, and thus the torque of the engine is controlled in the wrong direction and the surging erroneously increased. The probability of detecting vibration due to a rough road surface as surging is higher when the vehicle is traveling on an uneven road surface which causes a continuous and periodical longtitudinal vibration of the vehicle.

Further, the outer circumferences of the tires of the vehicle are not a ture circle and are, in practice, distorted from that shape, and as a result, the vehicle may vibrate in accordance with the rotation of the tires to thereby produce a primary rotational vibration at the tires. In this case, if a frequency of the primary rotational vibration at the tires matches a frequency of the natural vibration of a vehicle driving system, the vehicle driving system is resonated and this resonance is detected as a vibration caused by surging, whereby the torque of the engine is controlled in a wrong direction to thereby erroneously increase the surging.

SUMMARY OF THE INVENTION

An object of the present invention is to provide a method and apparatus for preventing a surging of a vehicle having an internal combustion engine in which surging due to only a vibration of the vehicle caused by the variations of the combustion cycle of the engine can be detected, to thus redude the surging of the vehicle, the vibration of the vehicle caused by driving on a rough road surface is not detected as surging, and a vibration of the vehicle caused by the matching of the frequency of the primary rotational vibration of the tires with the frequency of the natural vibration of a vehicle driving system is ignored with regard to the control of the engine torque.

According to one aspect of the present invention, a vibration period of the vehicle and a vibration amplitude due to the variations of the cycle of the cumbustion internal combustion engine are detected, and the detected vibration period of the vehicle in accordance with a driving condition of the vehicle is compared with the natural vibration period of the vehicle driving system stored in a memory device in accordance with the driving condition of the vehicle when the vibration amplitude is larger than a predetermined value. When the detected vibration period is equal to the natural vibration period of the vehicle driving system under a present driving condition, i.e., driving condition under which the variation period is detected, it is determined that the surging due to vibration caused by the variations of the combustion cycle of the engine has occurred, and thus the torque of the engine will be increased.

According to another aspect of the present invention, a primary rotational vibration period of the tire is calculated in accordance with a rotational speed of the engine, a vehicle driving speed, and a gear position of a transmission of the engine, and the calculated primary rotational vibration period is compared with the natural vibration period of the vehicle driving system under a present driving condition. When the primary rotational vibration period is equal to the natural vibration period of the vehicle driving system, the torque control for preventing surging is prohibited to prevent an erroneous detection thereof as surging.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
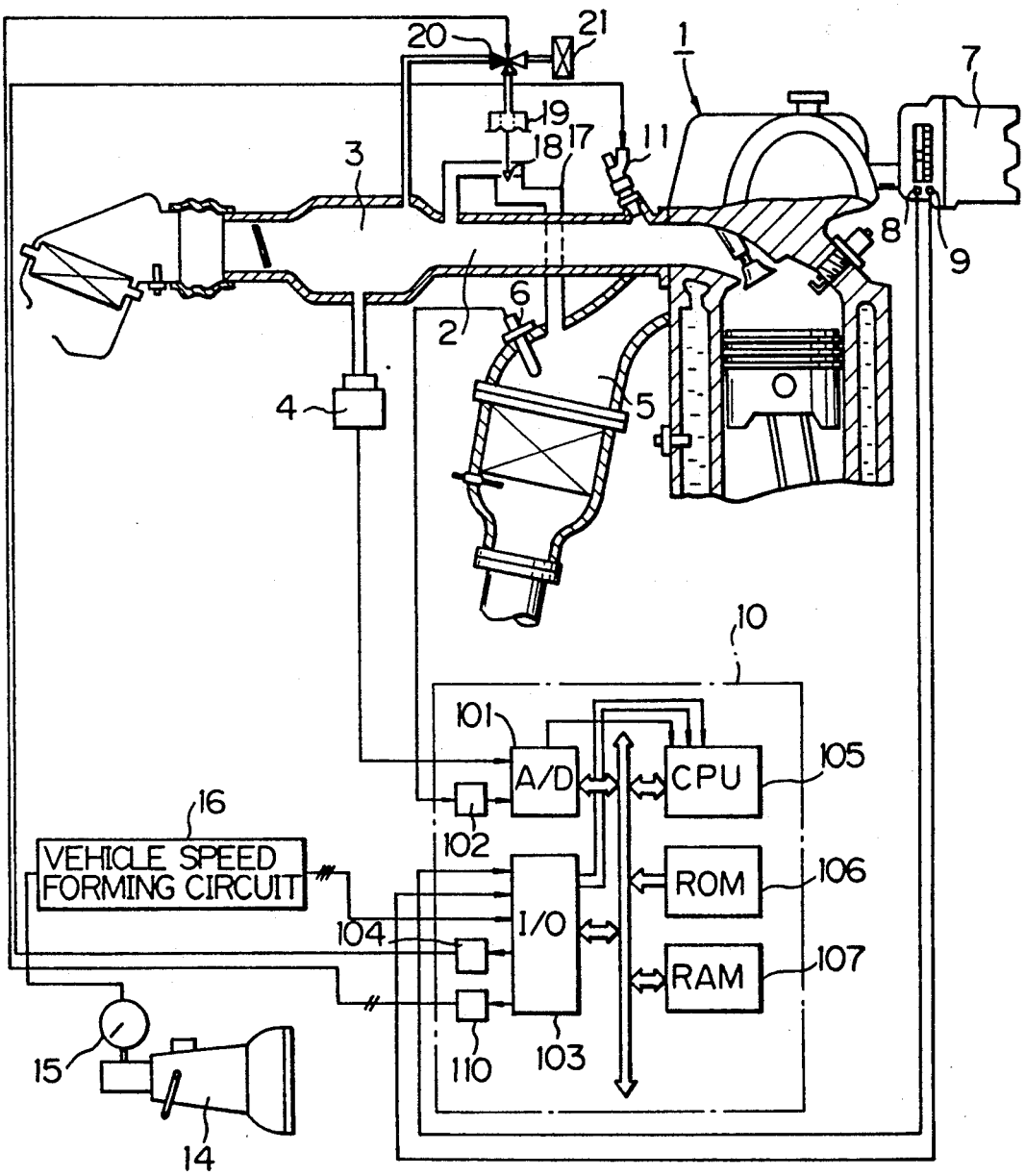
FIG. 1 is a schematic diagram of an internal combustion engine according to the present invention.

In FIG. 1, which illustrates an internal combustion engine according to the present invention, 1 designates a four-cycle spark ignition engine disposed in an automotive vehicle, and provided in a surge tank 3 of an air-intake passage 2 of the engine 1 is an air-pressure sensor 4 for detecting the absolute pressure of air taken into the engine 1, to thereby generate an analog voltage signal in proportion to the pressure of air flowing therethrough. The signal of the air-pressure sensor 4 is transmitted to a multiplexer-incorporating analog-to-digital (A/D) converter 101 of a control circuit 10.

Provided in an exhaust gas passage 5 of the engine 1 is a lean mixture sensor 6 for detecting the concentration of oxygen in the exhaust gas. The lean mixture sensor 6 generates an output current signal according to an air-fuel ratio and transmits same to the A/D converter 101 of the control circuit 10 via a current-voltage conversion circuit 102.

Disposed in a distributer 7 are crank-angle sensors 8 and 9 for detecting the angle of the crankshaft (not shown) of the engine 1. In this case, the crank-angle sensor 8 generates a pulse signal at every 720° crank angle (CA) while the crank-angle sensor 9 generates a pulse signal at every 30° CA. The pulse signals of the crank-angle sensors 8 and 9 are supplied to an input-/output (I/O) 103 interface of the control circuit 10. Further, the pulse signal of the crank-angle sensor 9 is then supplied to an interruption terminal of a central processing unit (CPU) 105 to be used as a 30° CA interruption signal for calculating a rotational speed Ne of the engine and an amount of fuel injection TAU.

Also provided in the air-intake passage 2 is a fuel injector 11 for supplying pressurized fuel from the fuel system (not shown) to the air-intake port of the cylinder of the engine 1. Note, other fuel injector valves are also provided for other cylinders, although not shown in FIG. 1.

Linking the exhaust gas passage 6 and the intake air passage 2 is an EGR (Exhaust Gas Recirculation) passage 17 having an EGR valve 18 located therein. The EGR valve 18 is linked to a negative pressure actuator 19 which is selectively connected by an electro-magnetic three way valve 20 to a negative pressure port of the surge tank 3 or to an atmosphere filter 21. When the electro-magnetic three way valve 20 is energized by the control circuit 10, ports "black"—"black" are connected and the negative pressure of the surge tank 3 is introduced via the electro-magnetic three way valve 20 into the actuator 19 to open the EGR valve 18. Conversely, when the electro-magnetic three way valve 20 is not energized, ports "white"—"white" are connected and atmospheric air is introduced via the filter 21 and the electro-magnetic three way valve 20 into the actuator 19, to close the EGR valve 18. In this case, the electro-magnetic three way valve is controlled by the duty ratio of a drive signal generated by a drive circuit 110 of the control circuit 10.

The control circuit 10, which may be constructed by a microcomputer, further comprises a read-only memory (ROM) 106 for storing a main routine, interrupt routines such as a fuel injection routine, an ignition timing routine, tables (maps), and constants, etc., a random access memory 107 (RAM) for storing temporary data, and a drive circuit 104 for driving the injection valve 11 and the like. The drive circuit 104 includes a down counter, a flip-flop and an amplifier circuit, used for controlling the fuel injection amount TAU, whereby an amount of fuel corresponding to the fuel injection amount TAU is injected into the fuel injection valve 11.

Interruptions occur at the CPU 105 when the A/D converter 101 completes an A/D conversion and generates an interrupt signal; when the crank angle sensor 9 generates a pulse signal; and when the clock generator generates a special clock signal.

The intake air pressure data Q of the air-pressure sensor 4 and the output current value of the lean mixture sensor 6 converted into the voltage value RL are fetched by an A/D conversion routine(s) executed at predetermined intervals and is then stored in the RAM 107. Namely, the data Q and the value RL in the RAM 107 are renewed at predetermined intervals. The engine speed Ne is calculated by an interrupt routine executed at 30° CA, i.e., at every pulse signal of the crank angle sensor 9, and is stored in the RAM 107.

Attached to a transmission 14 of the engine 1 is a speed sensor 15 for detecting the speed of the vehicle on which the engine 1 is mounted. The speed sensor 15 generates and transmits an output voltage signal to a vehicle speed signal forming circuit 16, and the vehicle speed signal forming circuit 16 forms a signal showing the speed of the vehicle and transmits it to the I/O 103 of the control circuit 10. Further, a signal from a throttle switch (not shown) for detecting an open or closed condition of a throttle valve and a signal from a throttle opening sensor (not shown) for detecting a throttle valve opening rate are input to the control circuit 10.

Before the operation of the control circuit 10 of FIG. 1, which will be explained hereinafter with reference to the flow charts of FIGS. 4, 5, 6, 7, 8, 9, 10, 11, 12, and 14, the relationship between a longtitudinal acceleration G of the vehicle and a change of the time difference DT180 is explained with reference to the waveforms of FIGS. 2A and 2B.

Figure 2A:
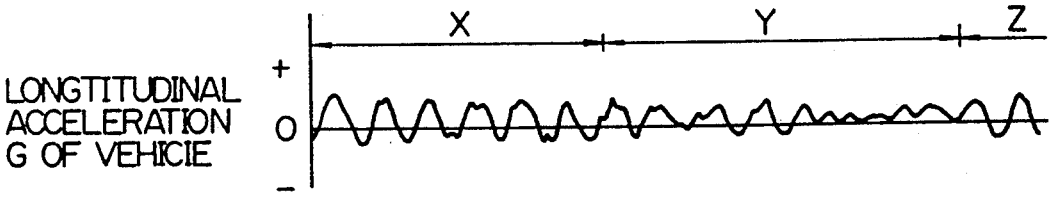
FIG. 2A is a waveform indicating a longtitudinal acceleration G of the vehicle.

FIG. 2A shows a model waveform of the longtitudinal acceleration G of the vehicle. In this model, the longtitudinal acceleration G is large in a period X, becomes smaller in a period Y, and becomes larger again in a period Z. FIG. 2B shows an alternation of the time difference DT180 when the longtitudinal acceleration G changes as shown in FIG. 2A. The time required for the crankshaft to rotate by the crank angle of 180° is called a 180° CA time, and the time difference DT180 is defined as the differential value obtained by the subtraction of two successively detected 180° CA times. As shown in FIGS. 2A and 2B, the time difference DT180 is large in the period X, becomes smaller in the period Y, and becomes larger again in the period Z, and thus a surging of the vehicle due to variations of the combustion cycle can be detected when the amplitude of the time difference DT180 is large and the period of the time difference DT180 is equal to the natural vibration period of the vehicle.

Figures 4, 4A:
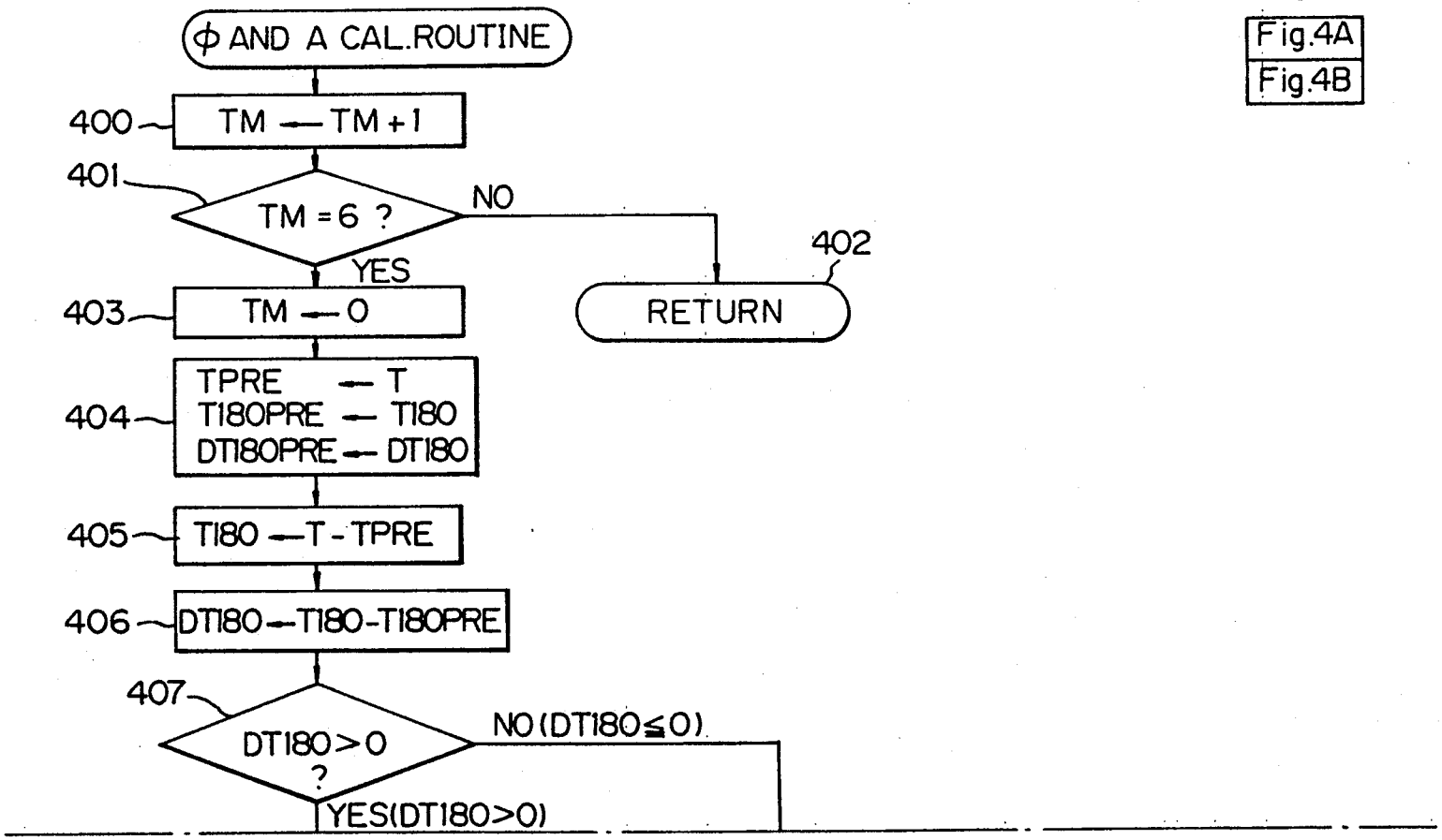
FIG. 4A, 4B, 5A, 5B, 6, 7, 8, 9A, 9B, 10A, 10B, 11, 12A, 12B, 14A, and 14B are flowcharts showing the operation of the control circuit of FIG. 1.
Figure 4B:
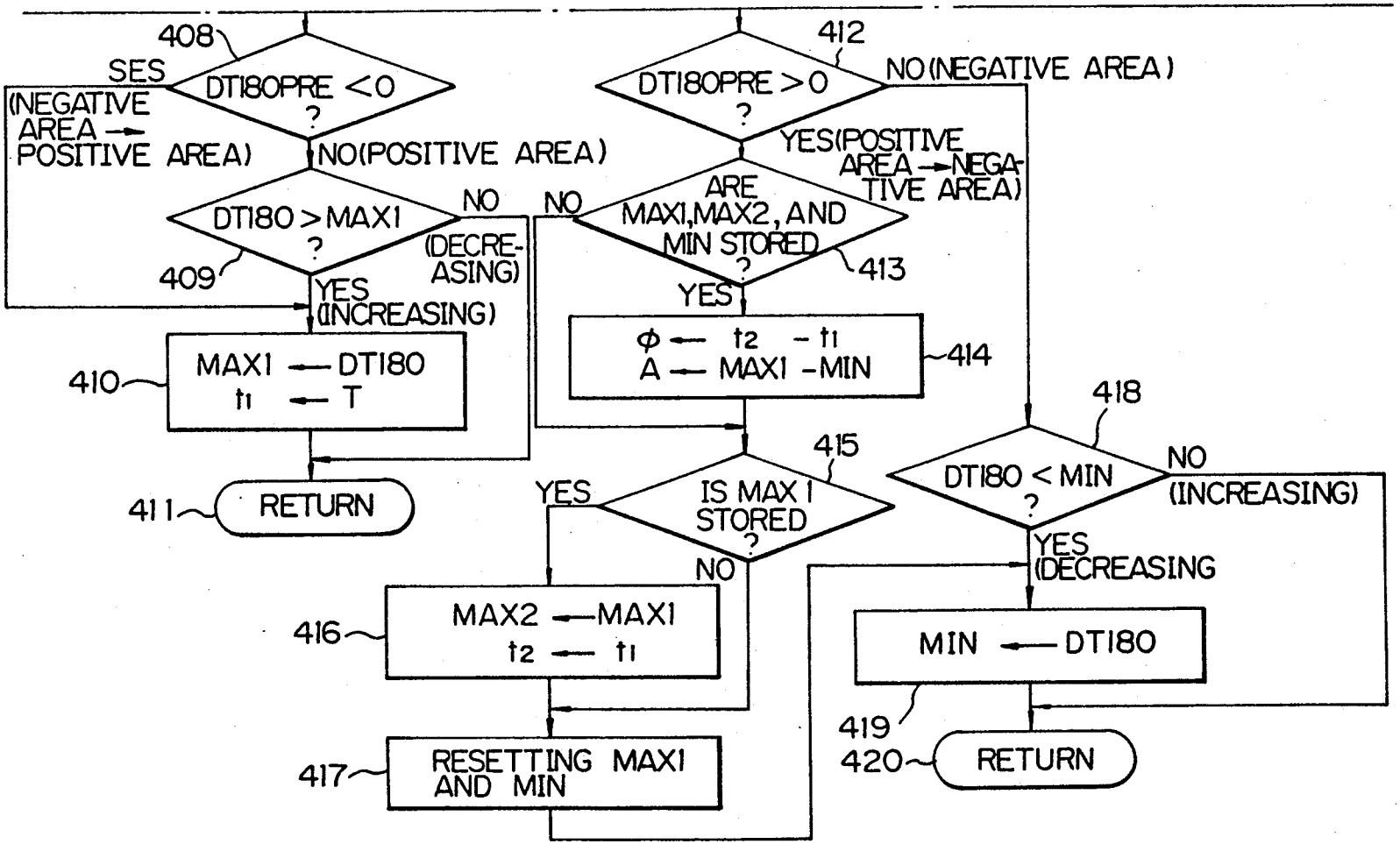

FIG. 4 shows a routine for calculating the time difference DT180, and the vibration period $\phi$ and the vibration amplitude A based on the variations of the combustion cycle occurring at every 30° crank angle, by a signal output by the crank angle sensor 9 of the distributor 7.

At step 400, a timing counter TM is incremented by 1, and at step 401, it is determined whether or not the count of the timing counter TM is equal to 6. If the count of the timing counter TM is not equal to 6, this routine is completed at step 402, but if the count of the timing counter TM is equal to 6, the control proceed to step 403 and the timing counter TM is reset. These steps 400 to 403 determine the calculation timing of the time difference DT180, since the time difference DT180 must be calculated at every 180° CA time.

Figure 7:
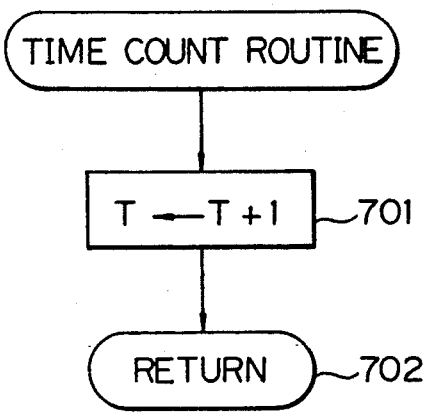

Accordingly, the control proceeds to step 404 at every 180° CA time, which is the time required for a piston of a cylinder to move from a top dead center to a bottom dead center, or vice versa, of the stroke thereof. Then, at step 404, a value of a time counter T, a time value T180, and the time difference DT180, all recorded at a prior 180° CA time, are stored in the RAM 107 as an old time value TPRE, T180PRE, and DT180PRE, to calculate the time difference DT180 in this routine. Thereafter, the value of the time counter T is read out and stored in the RAM 107 as a present time, and the time value T180 is calculated by $$T180 \leftarrow T - TPRE$$

at step 405. The time counter T countes the time at step 701 of the time count routine shown in FIG. 7. (In practice, the present time value T180 is recorded at ATDC 10° for every cylinder according to the timing of the output signal from the crank-angle sensor 9.) The routine of FIG. 7 is completed by step 702.

Figure 3:
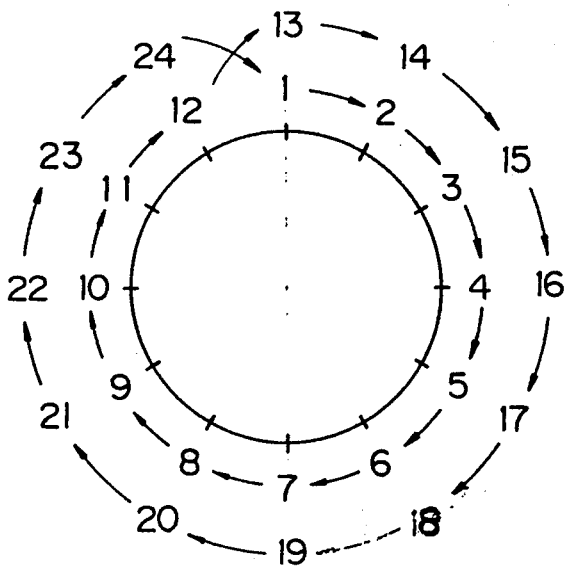
FIG. 3 is a chart explaining 30° crank angles and the signal output positions of a crank angle sensor.

Further, the crankshaft rotates for 720° (720° CA) at one stroke of the piston of the engine, so that the crank-angle sensor 9 generates 24 signals at every 30° CA for one stroke of the piston of the engine, as shown in FIG. 3. Accordingly, the value of the time counter T is recorded at No. 1, 7, 13, and 19 of output signals from the crank-angle sensor 9, to calculate the time value T180. Although the calculation of the time difference DT180 and the time value T180 are explained in the same routine in the present invention, the calculation of the time difference DT180 may be carried out after the calculation of the time value T180. For example, when the calculation of the time value T180 is carried out at the 1st and 7th output signals from the crank-angle sensor 9, the calculation of the time difference DT180 may be carried out at the 2nd and 8th output signals from the crank-angle sensor 9.

After step 405, the control proceeds to step 406, at which the calculation of the time difference DT180 is carried out as follows:

$$DT180 \leftarrow T180 - T180PRE.$$

Then, at step 407, it is determined whether or not the time difference DT180 is larger than 0, and if $DT180 > 0$, the control proceeds to step 408. If $DT180 \leqq 0$, the control proceeds to step 412.

At step 408, it is determined whether or not the time difference at the last routine DT180PRE is smaller than 0. If $DT180PRE < 0$, which indicates DT180 when the time difference changes from a negative area to a positive area, the control proceeds to step 410, at which the time difference DT180 is set as the maximum value MAX1 and the value of the counter T is recorded in the RAM 107 as time t1, and the control then proceeds to step 411 to complete the routine. IF $DT180PRE \geqq 0$ at step 408, which indicates that the time difference DT180 is still in a ositive area, the control proceeds to step 409 to determine whether or not the time difference DT180 is larger than the maximum value MAX1. If $DT180 > MAX1$, which indicates that the time difference DT180 is increasing, the control proceeds to step 410, but if $DT180 \leqq MAX1$, which indicates that the time difference DT180 is decreasing, the control proceeds to step 411 to complete the routine.

At step 412, it is determined whether or not DT180PRE is larger than 0. If $DT180PRE > 0$, which indicates that the time difference DT180 has changed from the positive area to the negative area, the control proceeds to step 413, but if $DT180PRE \leqq 0$, which indicates that the time difference DT180 is still in the negative area, the control proceeds to step 418. At step 413, it is determined whether or not the maximum value MAX1, a maximum value MAX2, and a minimum value MIN are all stored in the RAM 107. If MAX1, MAX2, and MIN are all stored in the RAM 107, the control proceeds to step 414. If at least one of MAX1, MAX2, and MIN is not stored in the RAM 107, the control proceeds to step 415. At step 414, the vibration period $\phi$ and the amplitude of the vibration A are calculated by $$\phi \leftarrow t2 - t1$$

$$A \leftarrow MAX1 - MIN$$

and the control then proceeds to step 415. At step 415, it is determined whether or not the maximum value MAX1 is stored in the RAM 107. If MAX1 is stored in the RAM 107, the control proceeds to step 416 at which the maximum value MAX1 is set as the maximum value MAX2 and the value of the counter t1 is recorded in the RAM 107 as time t2, and then proceeds to step 417. If MAX1 is not stored in the RAM 107, the control proceeds to step 417 and the maximum value MAX1 and the minimum value MIN are reset, and the control then proceeds to step 419. At step 418, it is determined whether or not the time difference DT180 is smaller than the minimum value MIN. If $DT180 < MIN$, which indicates that the time difference DT180 is decreasing, the control proceeds to step 419, but if $DT180 \geqq MIN$, which indicates that the time difference DT180 is increasing, the control proceeds to step 420 to complete the routine. At step 419, the time value DT180 is set as the minimum value MIN and the control then proceeds to step 420 to complete the routine.

The flowchart of FIG. 4 will be explained in more detail with reference to FIG. 2B. When the time difference DT180 is increasing, the point $\alpha$ in FIG. 2B is calculated as the maximum value MAX1, and at the same time the time T is recorded as time t1. When a change of the time difference DT180 from positive area to negative area is detected, the point $\alpha$ is recorded as the maximum value MAX2, and at the same time, the time t1 is recorded as the time t2. Then the point $\beta$ is calculated as the minimum value MIN, and thereafter, the point $\gamma$ is calculated as the maximum value MAX1, and at the same time, the time T is recorded as time t1. In this way, when the datum of the points $\alpha$, $\beta$, and $\gamma$ are all stored in the RAM 107, the vibration period $\phi$ and the amplitude of vibration A are calculated by $$\phi \leftarrow t2 - t1$$

$$A \leftarrow MAX1 - MIN.$$

Note, torque is generated when gas expands in each cylinder in a four cycle combustion engine, and thus the torque is intermittently delivered to the crankshaft. Accordingly, the variation of the crankshaft due to this intermittent torque is often superposed on the signal from the crank-angle sensor 9, as noise, and when the crank-angle sensor 9 is attached to a distributor connected directly to a camshaft, impact vibration from the cam is delivered to the crank-angle sensor 9 and becomes noise in the output signal therefrom. In such cases, it is difficult to detect an exact vibration period $\phi$ and exact amplitude of the vibration A over the wide range of engine rotation, and thus the time difference DT180 must be calculated by using a average value of the signals from the crank-angle sensor 9 over the whole rotational area of the engine. Further, when the turning point of the time difference DT180 from a positive area to a negative area, or vice versa, is difficult to calculate due to the aforementioned noise, a dead zone should be set near the point at which the difference of the T180° time is equal to 0.

Figures 5, 5A, 5B:
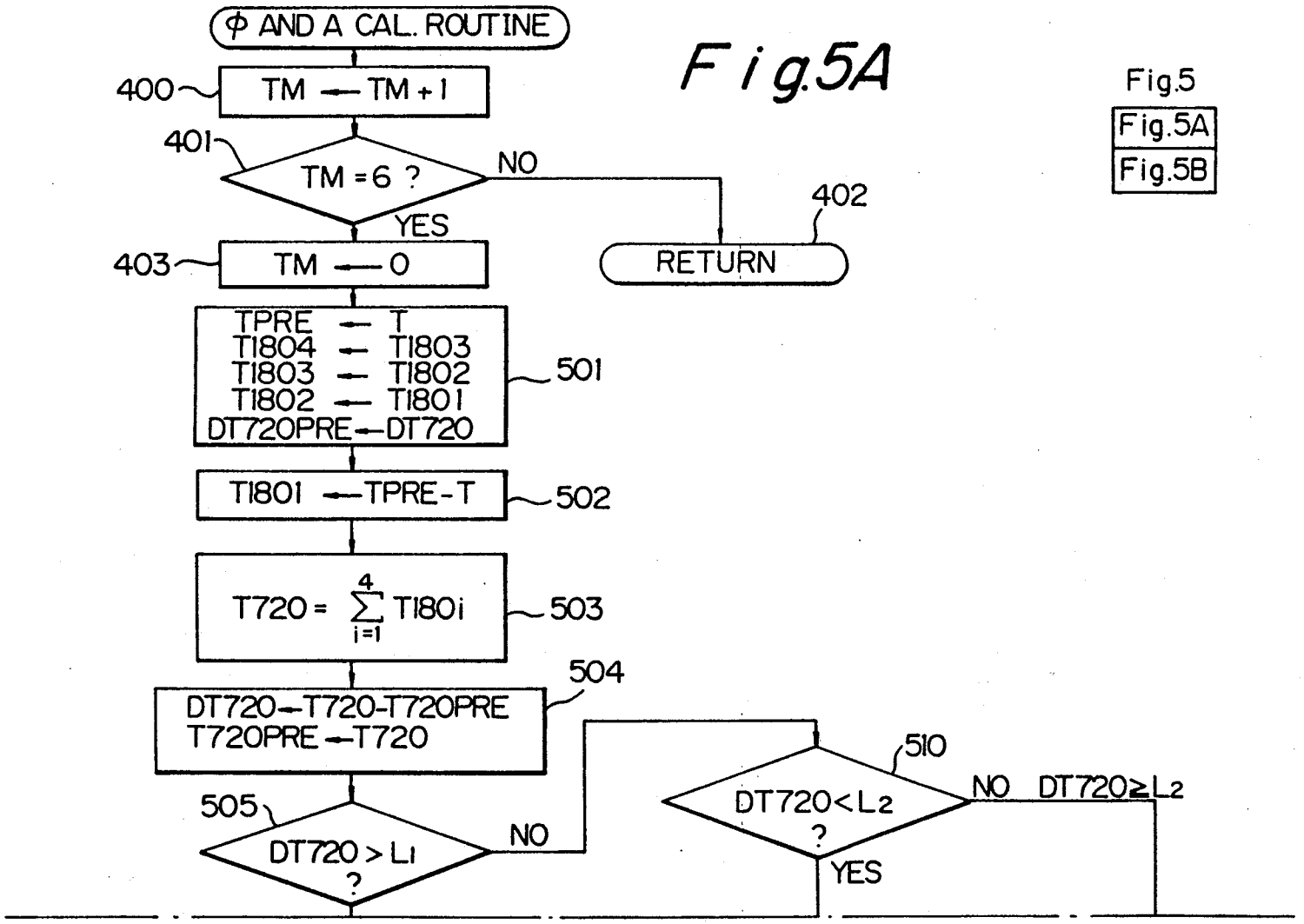
Figure 5B:
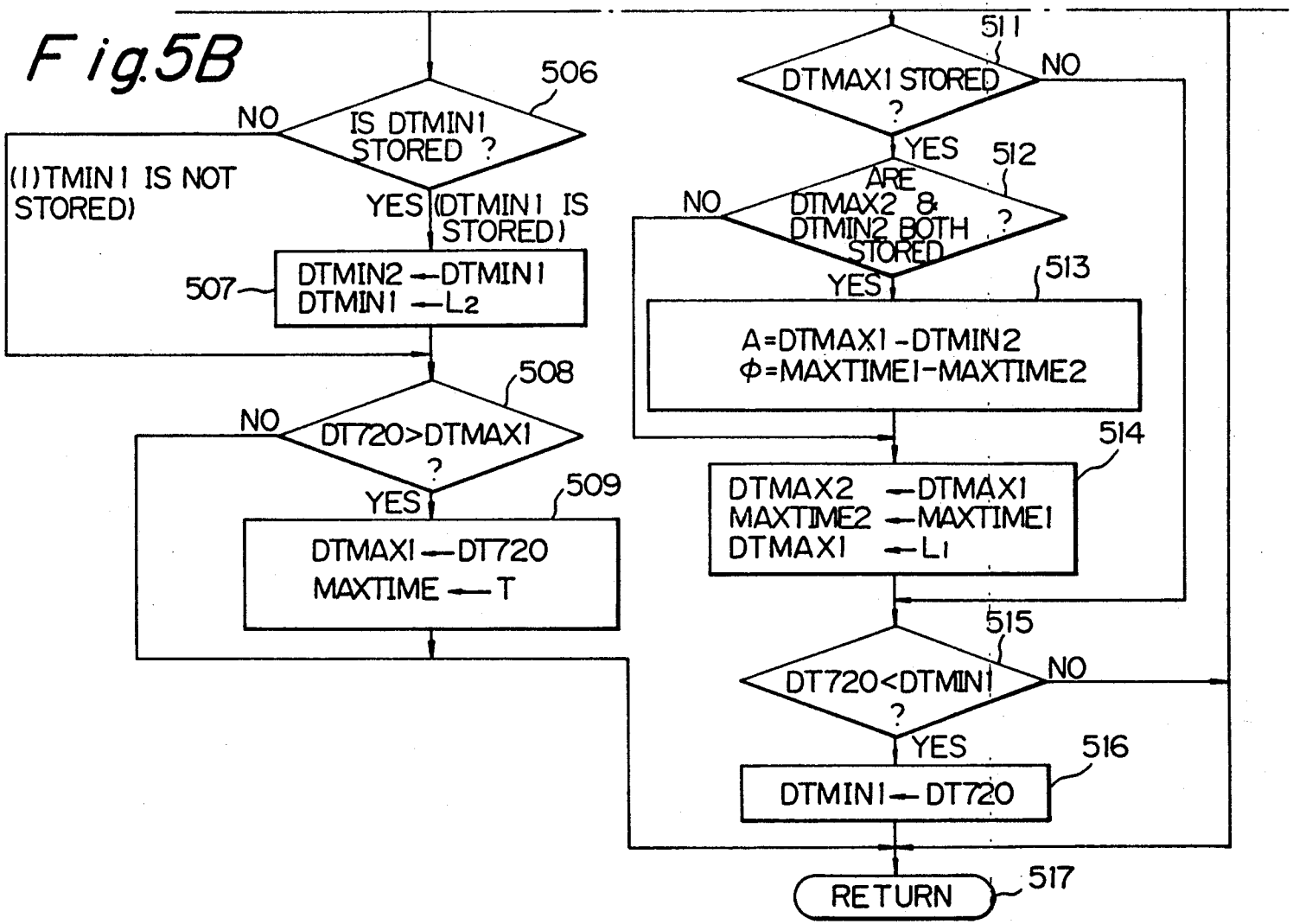

FIG. 5 is a routine for calculating the time difference DT720, and the vibration period $\phi$ and the vibration amplitude A using a average value of the signals from the crank-angle sensor 9. This routine is also executed at every 30° crank angle by a signal from the crank angle sensor 9 of the distributor 7.

Steps 400 to 403 in FIG. 5 correspond to the same steps in FIG. 4, and accordingly, an explanation thereof is omitted. At step 501, a value of a time counter T is stored in the RAM 107 as an old time value TPRE; a time value T1803, which is the time value T180 recorded 540° CA priviously, is stored in the RAM 107 as T1804; a time value T1802, which is the time value T180 recorded 360° CA priviously is stored in the RAM 107 as T1803; a time value T1801, which is the time value T180 recorded 180° CA priviously is stored in the RAM 107 as T1802; and the time difference DT720 is stored in the RAM 107 as DT720PRE. Then the control proceeds to step 502, at which the value of the time counter T is read out and stored in the RAM 107 as a present time, and the time value T1801 is calculated by $$T1801 \leftarrow T - TPRE.$$

At step 503, a time value T720 which is a sum of four T180 time values in the last three routines and in this routine is calculated by $$T720 \leftarrow T1801 + T1802 + T1803 + T1804$$

and the control then proceeds to step 504, at which the calculation of the time difference DT720 is carried out by $$DT720 \leftarrow T720 - T720PRE.$$

Figure 2B:
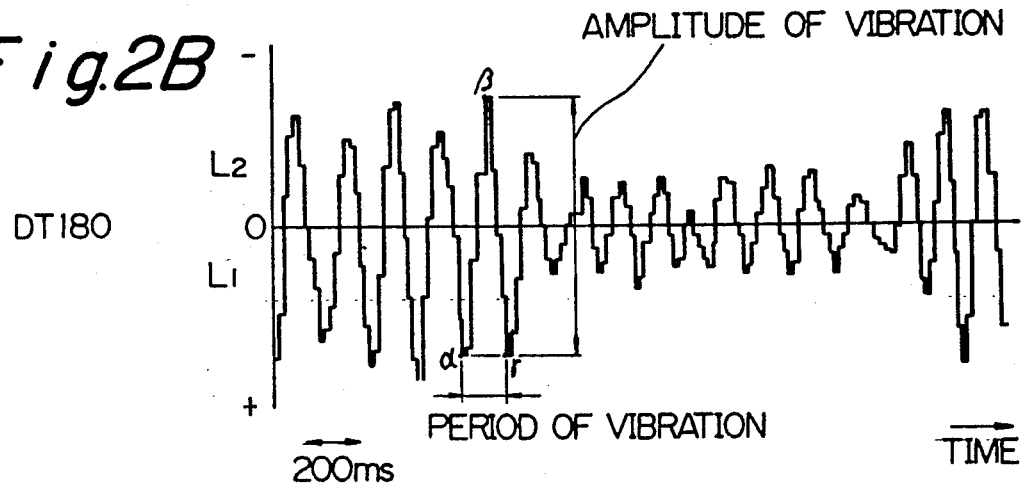
FIG. 2B is a waveform indicating a change of the time difference DT180 in comparison with the longtitudinal acceleration G shown in FIG. 2A.

Then at step 505, it is determined whether or not the time difference DT720 is larger than an upper limit $L_1$ of the dead zone (shown in FIG. 2B). If $DT720 > L_1$, the control proceeds to step 506, and if $DT720 \leqq L_1$, the control proceeds to step 510.

At step 506, it is determined whether or not a minimum value DTMIN1, except a lower limit $L_2$ (shown in FIG. 2B) of the dead zone, is stored in the RAM 107. If the minimum value DTMIN1 is stored in the RAM 107, the control proceeds to step 507, at which the minimum value DTMIN1 is stored in the RAM 107 as a minimum value DTMIN2, and the lower limit $L_2$ of the dead zone is stored in the RAM 107 as the minimum value DTMIN1. If the minimum value DTMIN1 is not stored in the RAM 107, the control proceeds to step 508. At step 508, it is determined whether or not the time difference DT720 is larger than the maximum value DTMAX1. If $DT720 > DTMAX1$, the control proceeds to step 509, at which the time difference DT720 is set as the maximum value DTMAX1 and the value of the counter T is recorded in the RAM 107 as a time MAXTIME1, and the control then proceeds to step 517 to complete the routine. If $DT720 \leqq DTMAX1$, the control proceeds to step 517 to complete the routine.

At step 510, it is determined whether or not the time difference DT720 is smaller than the lower limit $L_2$ of the dead zone, and if $DT720 < L_2$, the control proceeds to step 511. If $DT720 \geqq L_2$, which indicates that the time difference DT720 is still between the lower limit $L_2$ and the upper limit $L_1$, the control proceeds to step 517 to complete the routine. At step 511, it is determined whether or not a maximum value DTMAX1, except the upper limit $L_1$ of the dead zone, is stored in the RAM 107. If the maximum value DTMAX1 is stored in the RAM 107, the control proceeds to step 512, but if the maximum value DTMAX1 is not stored in the RAM 107, the control proceeds to step 515. At step 512, it is determined whether or not a maximum value DTMAX2 and a minimum value DTMIN2 are both stored in the RAM 107. If the maximum value DTMAX2 and the minimum value DTMIN2 are both stored in the RAM 107, the control proceeds to step 513, but if the maximum value DTMAX2 and the minimum value DTMIN2 are not both stored in the RAM 107, the control proceeds to step 514. At step 513, the vibration period $\phi$ and the amplitude of the vibration A are calculated by $$\phi \leftarrow MAXTIME1 - MAXTIME2$$

$$A \leftarrow DTMAX1 - DTMIN2$$

and the control then proceeds to step 514.

At step 514, the maximum value DTMAX1 is stored in the RAM 107 as a maximum value DTMAX2, the time MAXTIME1 is stored in the RAM 107 as the time MAXTIME2, and the lower limit $L_1$ of the dead zone is stored in the RAM 107 as the maximum value DTMAX1, and the control then proceeds to step 515. At step 515, it is determined whether or not the time difference DT720 is smaller than the minimum value DTMIN1, and if $DT720 < DTMIN1$, the control proceeds to step 516, but if $DT720 \geqq DTMIN1$, the control proceeds to step 517 to complete the routine. At step 516, the time difference DT720 is stored as the minimum value DTMIN1, and then the control proceeds to step 517 to complete the routine.

In this routine, first the time difference DT720 is calculated by adding four sequential DT180 times and then the time difference DT180 is calculated by the differential value of the time difference DT720 and DT720PRE at every 180° CA. Accordingly, in an four cycle engine, the differential value of the time difference DT720 and DT720PRE corresponds to the differential value of an expansion stroke of the same cylinder, and thus variations of the crank-angle at different cylinders due to differences of an air-fuel ratio can be ignored and the exact value of the vibration period $\phi$ can be calculated.

Figure 6:
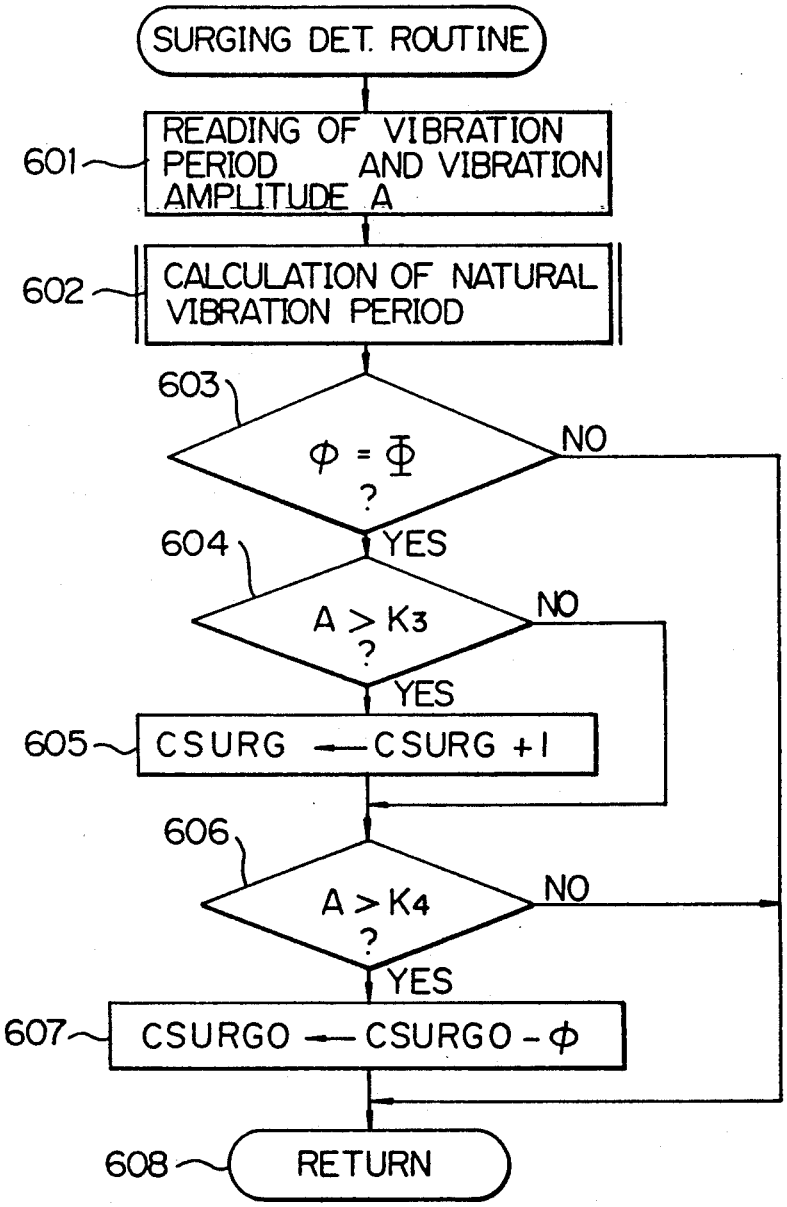

FIG. 6 is a routine for detecting a surging of the vehicle, and is executed at predetermined number of rotations of the engine. At step 601, the vibration period $\phi$ and the amplitude of the vibration A calculated in the routine shown in FIG. 4 are read out from the RAM 107, and at step 602, a calculation of a natural vibration period $\Phi$ is carried out in accordance with a driving condition parameter of the engine. The natural vibration period $\Phi$ is already calculated in accordance with the driving condition parameter, such as a vehicle speed, a rotaition speed of the engine, or a gear position decided by the vehicle speed and the rotational speed of the engine, and stored in the ROM 106, for example in the form of a map. Accordingly, at step 602, the natural vibration period $\Phi$ is calculated from the map by using the gear position and the rotational speed of the engine.

Then, at step 603, it is determined whether or not the vibration period $\phi$ is equal to the natural vibration period $\Phi$, and if $\phi=\Phi$, the control proceeds to step 604. If $\phi\neq\Phi$, the control proceeds to step 608 to complete the routine. At step 604, it is determined whether or not the vibration amplitude A is larger than a predetermined value $K_3$, which is a referential value used to determine an occurrence of surging. If $A\leqq K_3$, the control proceeds to step 606, but if $A>K_3$, the control determines that surging has occurred and proceeds to step 606, at which a counter CSURG for counting the number of occurrences of surging is incremented by 1.

At step 606, it is determined whether or not the vibration amplitude A is larger than a predetermined value $K_4$, which is smaller than the value $K_3$. If $A\leqq K_4$, the control proceeds to step 608 to complete the routine, but if $A>K_4$, the control proceeds to step 607, at which a counter CSRUG0 for counting 65 ms is decremented by $$CSRUG0 \leftarrow CSRUG0-\phi$$

where $\phi$ is the vibration period read out at step 601. The operations of steps 606 and 607 are carried out so that the count of the counter CSRUG0, which counts the continuous time in a state where a longitudinal vibration G on the vehicle is very small, is not increased, since if it is determined that $A>K_4$, a state of a comparatively large longtitudinal vibration G of the vehicle exists. The routine of FIG. 6 is completed by step 608.

Figure 8:
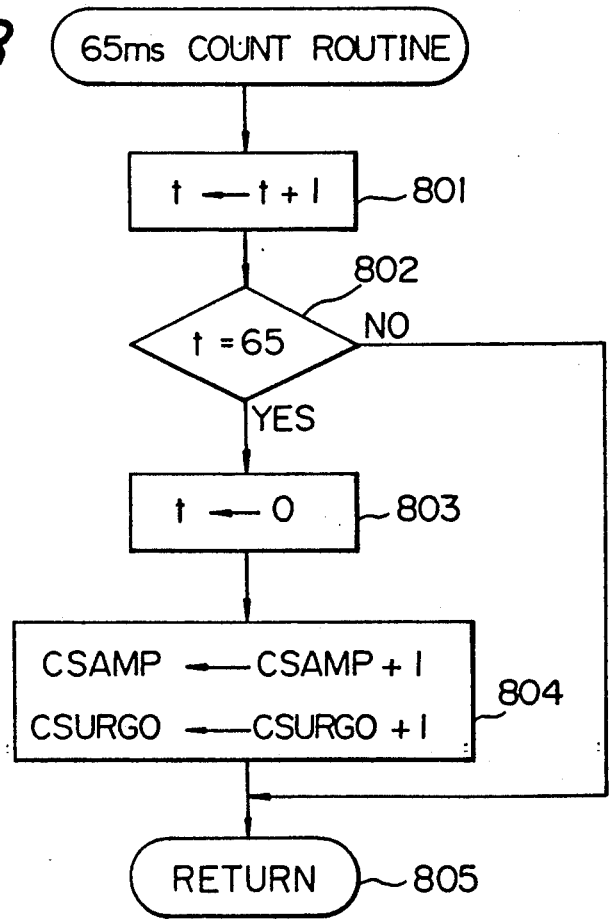

Note that the counter CSRUG0, which counts the continuous time in a state where a longtitudinal vibration G of the vehicle is very small, is incremented by 1 at every 65 ms in a time count routine shown in FIG. 8. In the time count routine executed at every 1 ms, a counter t is incremented by 1 at step 801, and at step 802, it is determined whether or not the counter t is equal to 65. If the counter t is not equal to 65, the control proceeds to step 805 to complete the routine, but if the counter is equal to 65, the control proceeds to step 803 to reset the counter t and then proceeds step 804. At step 804, the counter DSRUG0 is incremented by 1 and a counter CSAMP, which counts a measuring time, is also incremented by 1. The routine of FIG. 8 is completed by step 805.

Figures 9, 9A:
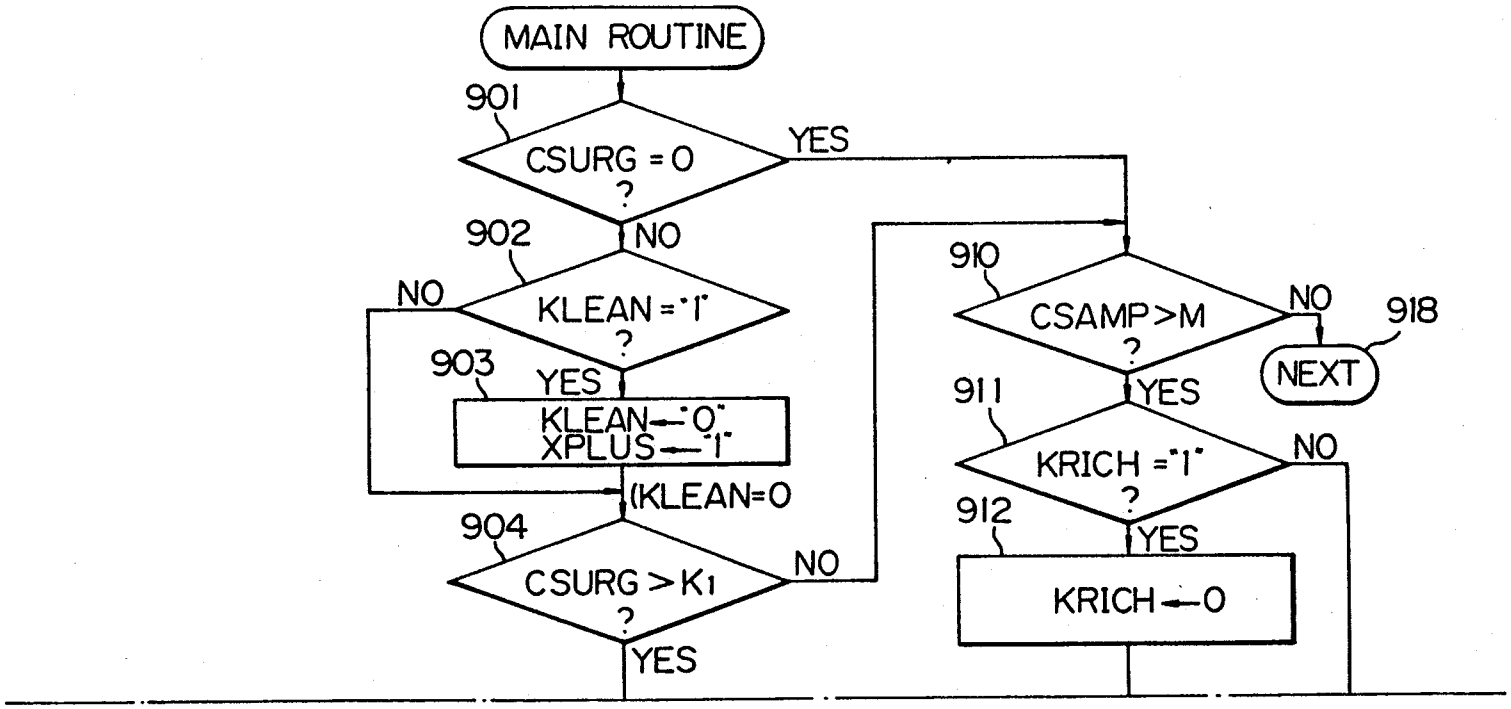
Figure 9B:
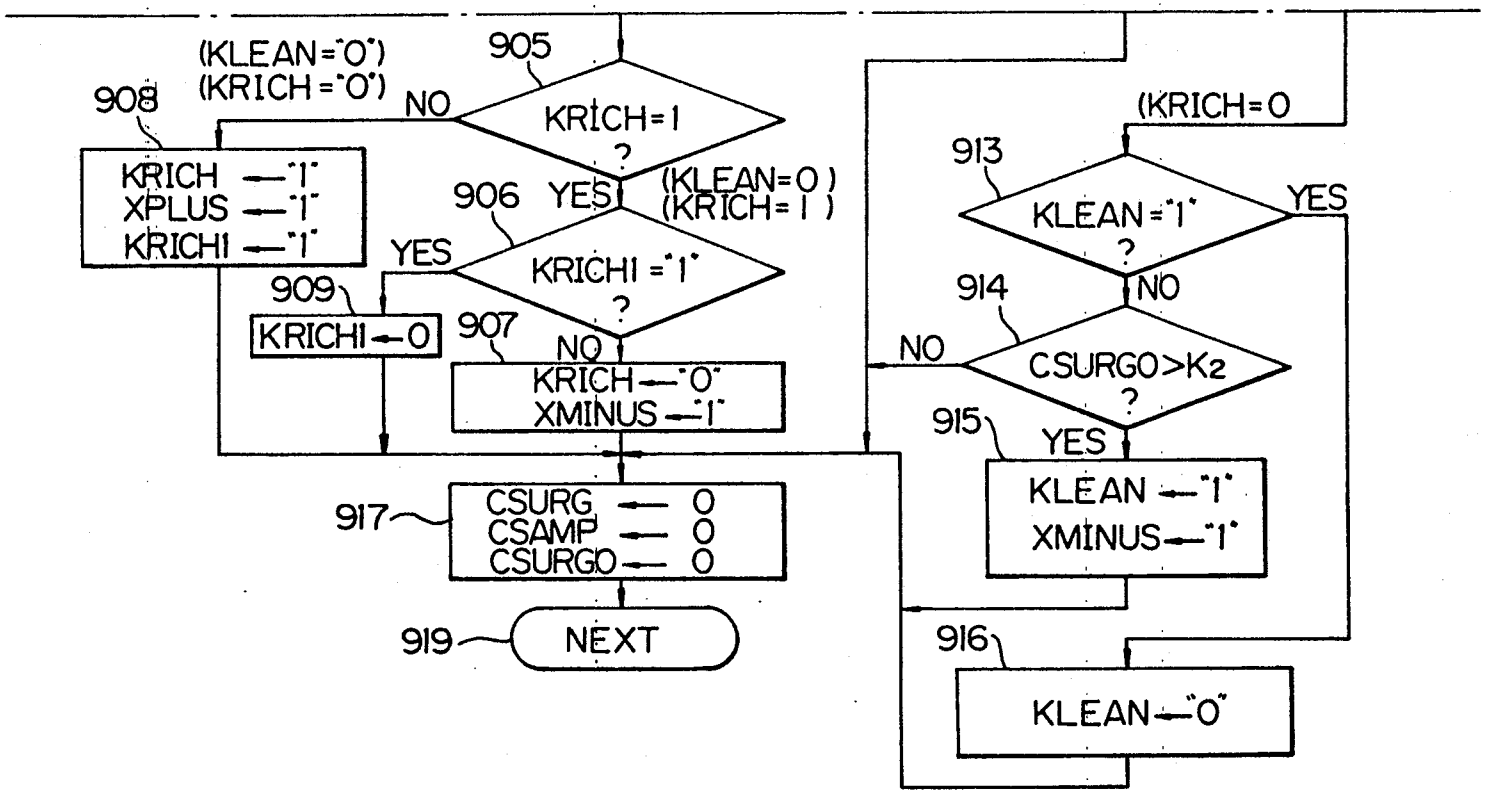

FIG. 9 shows the main routine of the control circuit 10 in FIG. 1. At step 901, it is determined whether or not the counter CSURG for counting the number of occurrences of surging is equal to 0, and if $CSURG\neq 0$, which indicates that surging is occurring, the control proceeds to step 902. If $CSURG=0$, which indicates that surging is not occurring, the control proceeds to step 910. In this routine, step 902 to step 909 are an operation carried out when surging of the engine is occurring, and step 910 to step 916 are an operation carried out when surging of the engine is not occurring. Accordingly, the operation when surging of the engine is occurring is first explained, and then the operation when surging of the engine is not occurring is explained. When surging is detected in this embodiment, first fuel injection amount TAU is increased, but the increment of the fuel injection amount TAU is stopped if surging will not be reduced by this increment of the fuel injection amount TAU because the surging is not the due to variations of the combustion cycle of the engine.

(1) The operation when surging of the engine is occurring

At step 902, it is determined whether or not a temporary lean flag KLEAN is equal to "1". The temporary lean flag KLEAN becomes "1" when the operation of temporarily reducing the fuel injection amount TAU is carried out. If KLEAN≠"1", the control proceeds to step 904, but if KLEAN="1", the control proceeds to step 903 because surging is occurring due to the temporary reduction of the fuel injection amount. At step 903, the flag KLEAN is set to "0" to stop the temporary reduction operation and a flag XPLUS for obtaining an increment of the fuel injection amount is set to "1".

At step 904, it is determined whether or not the counter CSURG for counting the number of occurrences of surging is larger than a predetermined value $K_1$. If $CSURG\leqq K_1$, the control proceeds to step 910, but if $CSURG>K_1$, the control proceeds to step 905, at which it is determined whether or not a temporary rich flag KRICH is equal to "1". The temporary rich flag KRICH becomes "1" when a temporary increase of the fuel injection amount TAU is carried out. If KRICH≠"1", the control proceeds to step 908, but if KRICH="1", the control proceeds to step 906. At step 908, the flag KRICH is set to "1", the flag XPLUS is set to "1" to carry out the temporary increase operation, and a flag KRICH1 for indicating the change of the flag KRICH from "0" to "1" is set to "1". On the other hand at step 906, it is determined whether or not the flag KRICH1 is "1". If the flag KRICH1 is "1", which indicates that the flag KRICH was changed to "1" in the preceding routine, the control proceeds to step 909, at which the flag KRICH1 is set to "0". If the flag KRICH1 is not "1", the control proceeds to step 907, at which the flag KRICH is set to "0" and a flag XMINUS for obtaining a reduction of the fuel injection amount is set to "1". Accordingly, the control proceeds to step 907 when a reduction of surging will not be obtained by a reductuion of the fuel injection amount TAU, i.e., when it is determined that the source of surging is not due to the variations of the combustion cycle of the engine but to an external effect such as the road conditions. After step 907, step 908, or step 909, the control proceeds to step 917 to reset the counters CSURG, CSAMP, and CSURG0. The routine of FIG. 9 is completed by step 919.

(2) The operation when surging of the engine is not occurring

At step 910, it is determined whether or not the counter CSAMP for counting a length of a measuring time is larger than a predetermined measuring time M. If CSAMP>M, the control proceeds to step 911, but if CSAMP≦M, the control completes this routine at step 918. At step 911, it is determined whether or not the flag KRICH is equal to "1", and if KRICH="1", the control proceeds to step 912 because surging of the engine has been reduced by an increase of the fuel injection amount TAU. If KRICH≠"1", the control proceeds to step 913. At step 912, the flag KRICH is set to "0" to change the temporary rich operation to a permanent increase operation, and the control then proceeds to step 917.

At step 913, it is determined whether or not the flag KLEAN is equal to "1", and if KLEAN is not equal to "1", the control proceeds to step 914. If KLEAN="1", the control proceeds to step 916 because it is determined that the surging did not occur after the lean operation of the air-fuel ratio, at which the flag KLEAN is set to "0" to change the temporary reduce operation to a permanent reduce operation, and the control then proceeds to step 917. At step 914, it is determined whether or not the counter CSURG0 is larger than a predetermined time value $K_2$, and if CSURG0≦$K_2$, the control proceeds to step 917, but if CSURG0>$K_2$, the control proceeds to step 915. At step 917, the counters CSURG, CSAMP, and CSURG0 are reset. The routine of FIG. 9 is completed by step 919.

Figure 10A:
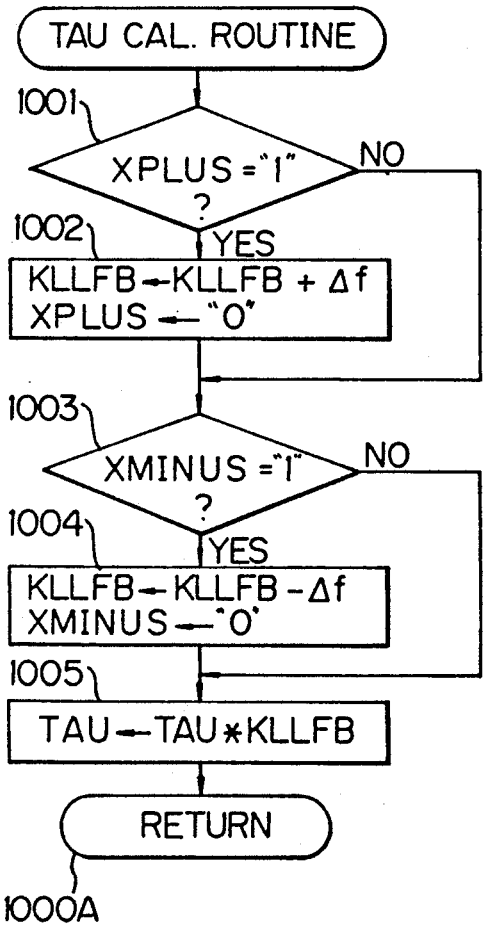

FIG. 10A shows the calculation of the fuel injection amount TAU using the flags XPLUS for requiring an increase of the fuel injection amount TAU and XMINUS for requiring a reduction of the fuel injection amount TAU executed at a predetermined crank-angle, for example, 360° CA, when the engine is a center injection type, and at 180° CA when the engine having four cylinders is a separate injection type. Note that the base fuel injection amount $\tau_P$ is calculated in accordance with the intake air pressure data PM and engine rotational speed data Ne, and the final fuel injection amount TAU is calculated with a correction of the base fuel injection amount $\tau_P$ in accordance with driving condition parameters such as an acceleration parameter and a warming-up parameter, although this is not shown. In the routine shown in FIG. 10A, the final fuel injection amount TAU is adjusted by a coefficient KLLFB.

At step 1001, it is determined whether or not the flag XPLUS is equal to "1", and if XPLUS="1", the control proceeds to step 1002, but if XPLUS≠"1", the control proceeds to step 1003. At step 1002, a correction coefficient KLLFB is increased by a predetermined value Δf, and at the same time, the flag XPLUS is set to "0" and the control proceeds to step 1003. At step 1003, it is determined whether or not the flag XMINUS is equal to "1", and if XMINUS="1", the control proceeds to step 1004, but if XMINUS≠"1", the control proceeds to step 1005. At step 1004, a correction coefficient KLLFB is decremented by a predetermined value Δf, and at the same time, the flag XMINUS is set to "0" and the control proceeds to step 1005. At step 1005, the fuel injection amount TAU is corrected by a multiplication of the coefficient KLLFB, whereby the fuel injection amount TAU is adjusted. The routine of FIG. 10A is completed by step 1000A.

According to the embodiment descrived above, air-fuel ratio can be controlled to be leaner when surging is determined to be not due to the engine, whereby the emissions can be reduced (mainly NOx is reduced), and accordingly, it is possible to preset the air-fuel ratio at the lean side (the side at which surging easily occurs) when it is expected that the air-fuel ratio will be made rich.

Note that the vibration period and the vibration amplitude of the vehicle due to variations of the combustion cycle are calculated in accordance with the output signal from the crank-angle sensor in the above-mentioned embodiment, but the vibration period and the vibration amplitude of the vehicle can be calculated from the output signal of an acceleration detecting sensor mounted on the vehicle.

Figure 10B:
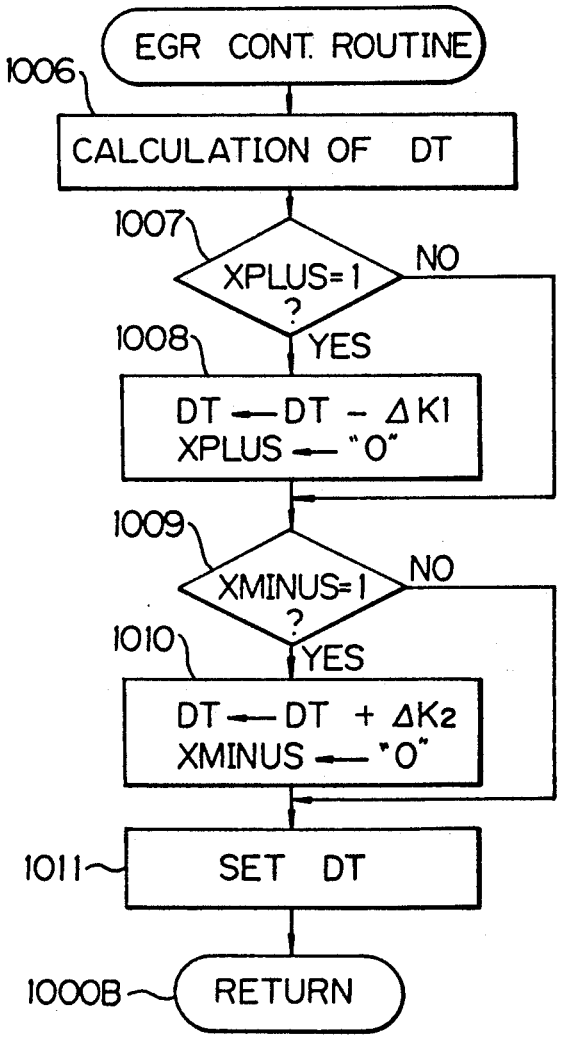

Further, the engine shown in FIG. 1 has a lean burning system, but if the present invention is applied to an engine having a stoichiometric air-fuel ratio control system, for example, an engine having an EGR system, the amount of EGR can be controled to decrease surging due to variations of the combustion cycle. FIG. 10B shows the routine dor a control of the amount of EGR using the flags XPLUS for reducing the amount of EGR and XMINUS for increasing the amount of EGR. Note that the EGR valve 18 is open when the electromagnetic three way valve 20 is energized by the control circuit 10 and the negative pressure of the surge tank 3 is introduced via the electro-magnetic three way valve 20 into the actuator 19, and the amount of EGR is controlled by the duty ratio DT of a signal generated by the control circuit 10. In this case, the amount of EGR is increased when the duty ratio DT is increased, and reduced when the duty ratio DT is reduced.

At step 1006, a duty ratio DT is calculated from a two-dimensional map stored in the ROM 106 using the pressure data PM of the air-pressure sensor 4 and the rotational speed Ne of the engine. Then at step 1007, it is determined whether or not the flag XPLUS is equal to "1", and if XPLUS="1", the control proceeds to step 1008. If XPLUS≠"1", the control proceeds to step 1009. At step 1008, the amount of EGR is reduced by $$DT \leftarrow DT - \Delta k1$$

where Δk1 is a predetermined definite value, and at the same time, the flag XPLUS is set to "0" and the control proceeds to step 1009. At step 1009, it is determined whether or not the flag XMINUS is equal to "1", and if XMINUS="1", the control proceeds to step 1010, but if XMINUS≠"1", the control proceeds to step 1011. At step 1010, the amount of EGR is increased by $$DT \leftarrow DT - \Delta k2$$

where Δk2 is a predetermined definite value, and at the same time, the flag XMINUS is set to "0" and the control proceeds to step 1011. At step 1011, the calculated duty ratio DT is set in the drive circuit 110, and accordingly, a drive signal having the duty ratio DT is applied by the drive circuit 110 to the electro-magnetic three way valve, thus controlling the EGR valve 18. Then the routine of FIG. 10B is completed by step 1000B.

Furthermore, although a period of the vibration is used for reducing surging due to variations of the combustion cycle, a signal having a frequency having a period which is the same as the vibration period can be used.

A further operation of the control circuit 10 will be explained with reference to FIG. 11 to FIG. 14. The operation of the control circuit 10 explained hereinafter is carried out to prevent surging due to the primary rotational vibration of the tires caused by the distortion of the tires while running. In this operation, the vibration period $\phi$ and the vibration amplitude A is calculate by the same routine as shown in FIG. 4 or FIG. 5.

Figure 11:
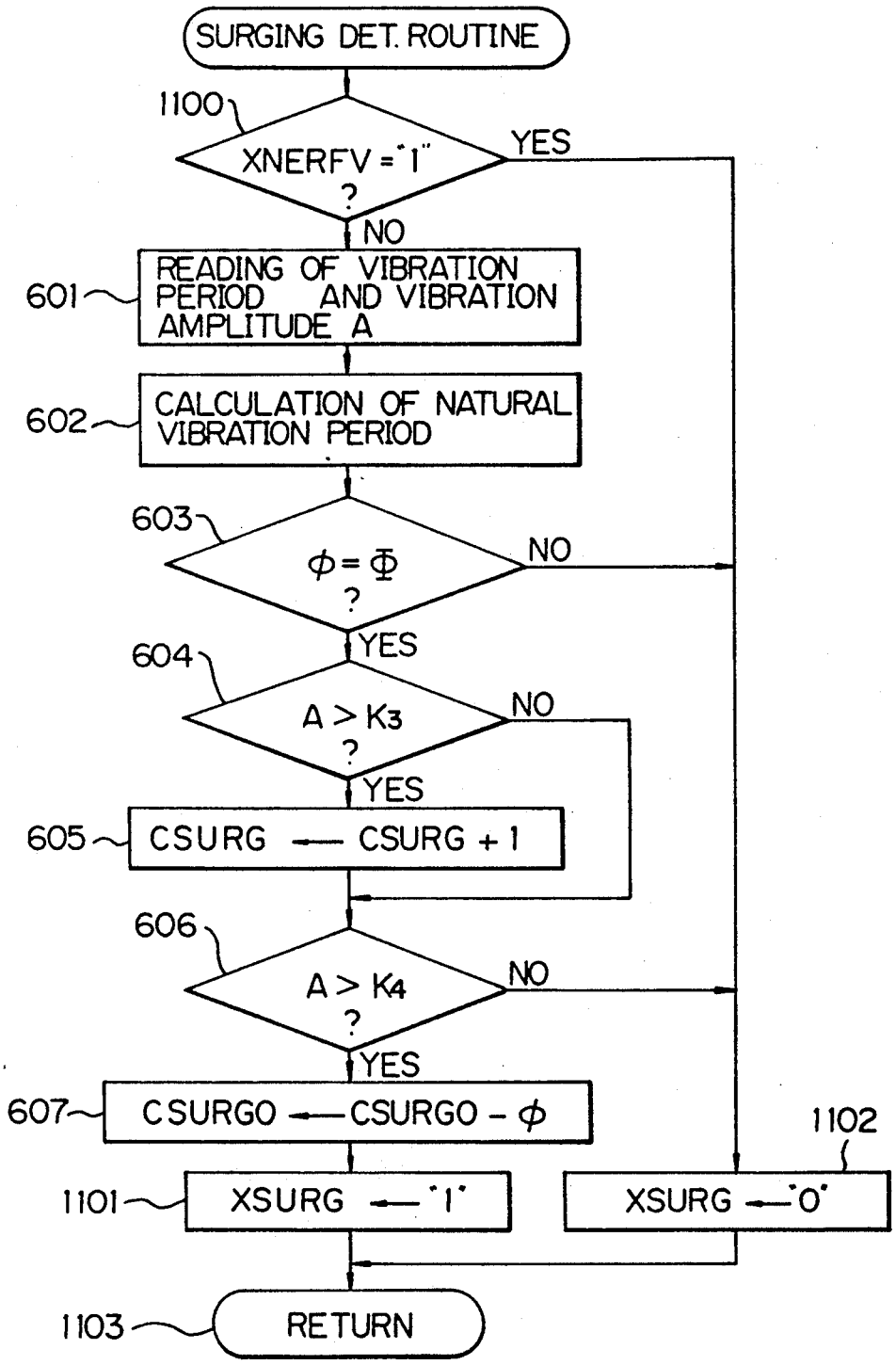

FIG. 11 is a modification of the flowchart shown in FIG. 6 and is also executed at a predetermined number of rotations of the the engine. In FIG. 11, steps 1100 to 1002 are added to steps 601 to 607 of FIG. 6.

At step 1001, it is determined whether or not a flag XNERFV is equal to "1". The flag XNERFV is set to "1" when the engine rotational speed remains at a rotational speed NeT, which is a rotational speed at which a primary rotational vibration frequency of the tires equivalent to the natural vibration frequency of the vehicle is generated. If XNERFV="1", the control proceeds to step 1102, at which a flag XSURGE for determining of a fuel injection should be made to prevent surging is set to "0". In this embodiment, the fuel injection is carried out when the flag XSURG is "1". If XNERFV is not "1" at step 1100, the control proceeds to step 601 to activate the operation of steps 601 to 607 as explained in FIG. 6. After step 607, the control proceeds to step 1101, at which the flag XSURGE is set to "1" to carry out the fuel injection. The routine of FIG. 11 is completed by step 1103.

Figures 12, 12A:
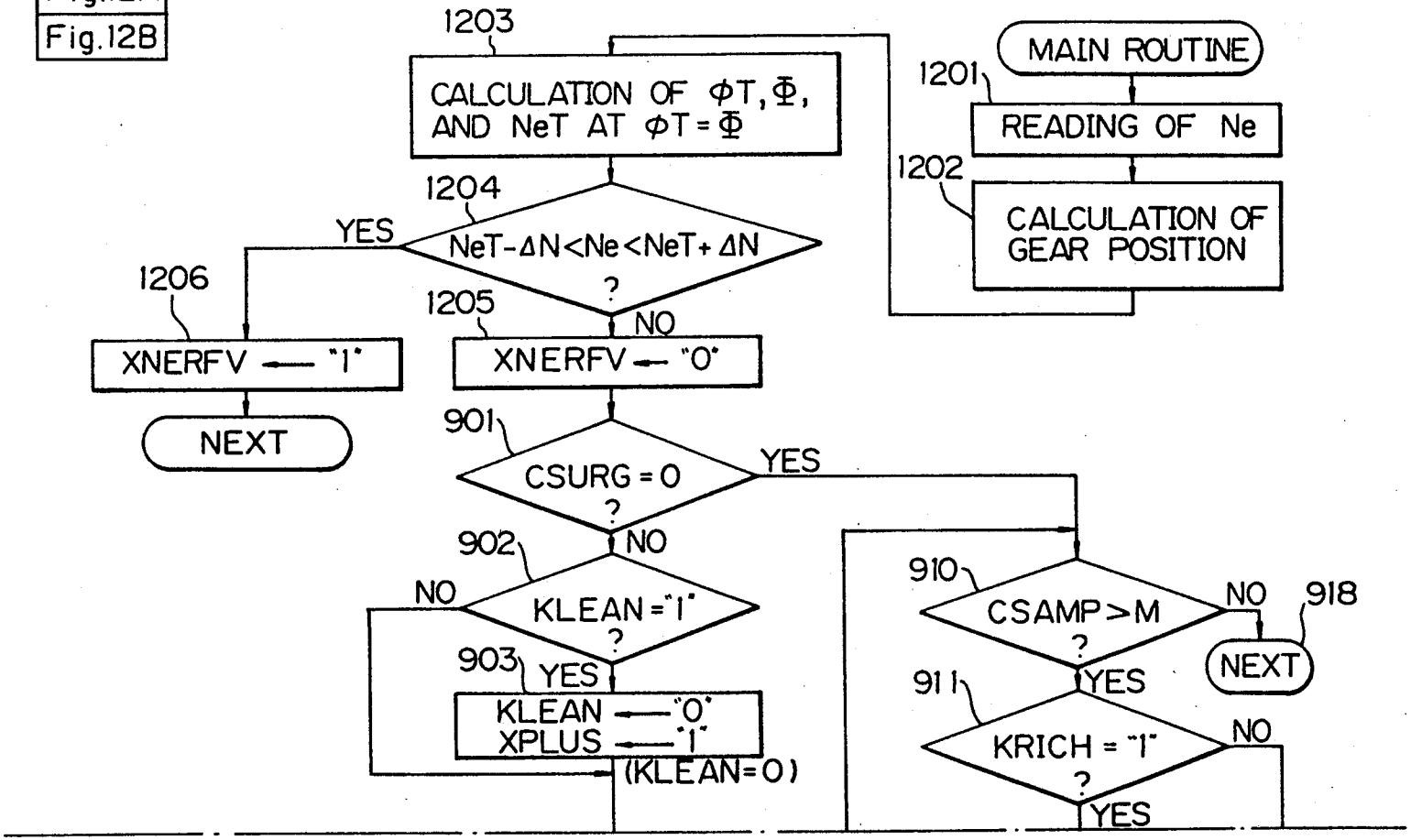
Figure 12B:
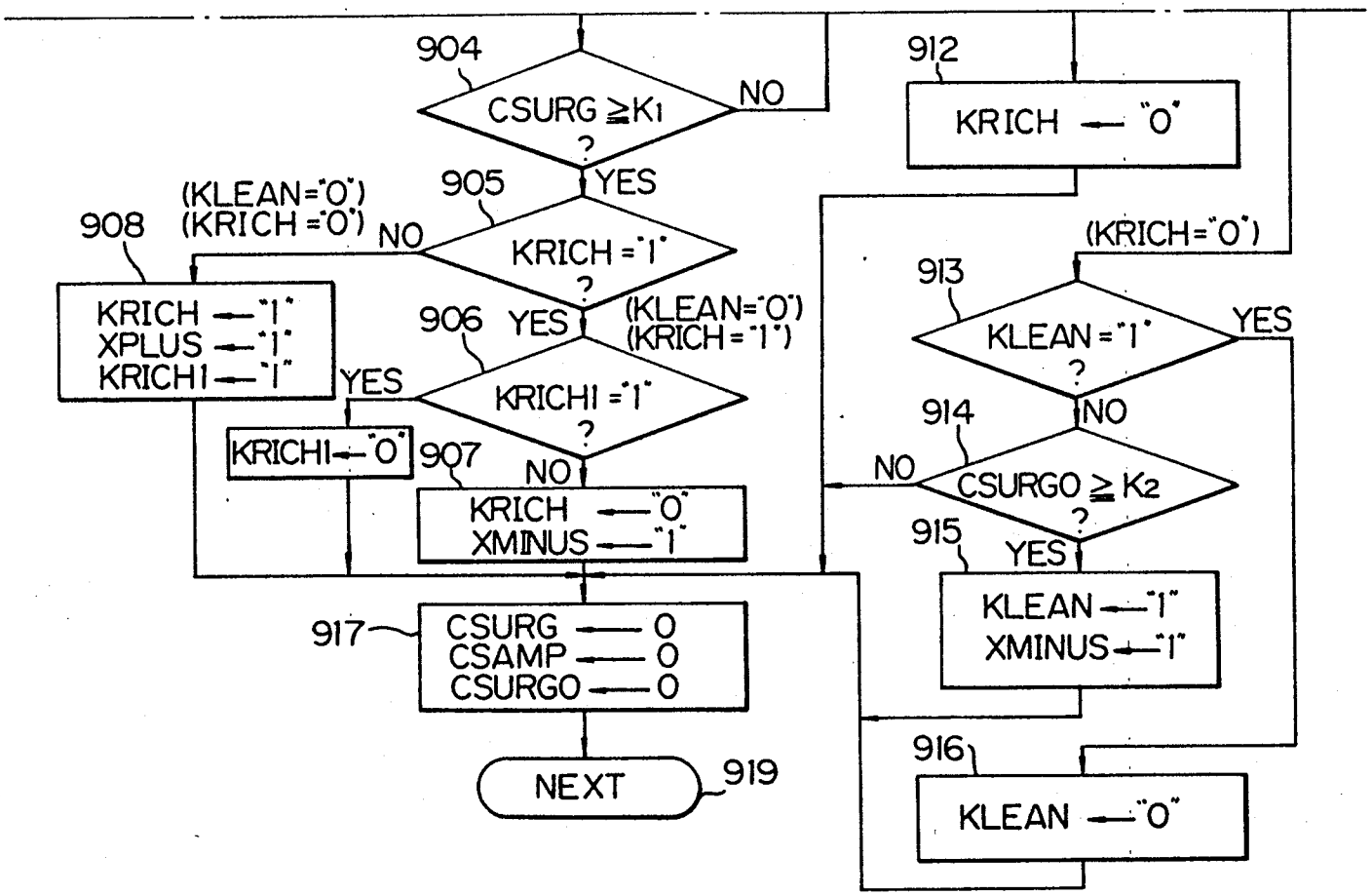

FIG. 12 is a modification of the flowchart shown in FIG. 9. In FIG. 12, steps 1201 to 1206 are added to steps 901 to 916 of FIG. 9.

At step 1201, the rotational speed Ne of the engine is read out and then at step 1202, the shift position of the transmission, i.e., the gear position is calculated by Ne/SPD, where SPD is the vehicle speed. At step 1203, the primary vibration period $\phi T$ of the rotating tires, the natural vibration period $\Phi$ of the vehicle, and the rotational speed NeT of the engine, which corresponds to $\phi T=\Phi$, are calculated. The primary vibration period $\phi T$ of rotating tires can be calculated in accordance with the rotational speed Ne of the engine and the gear position, and the natural vibration $\Phi$ can be calculated in accordance with the gear position. The rotational speed NeT of the engine, which corresponds to $\phi T=\Phi$, is calculated univocally in accordance with the gear ratio and the differential gear ratio as shown in FIG. 13.

Figure 13:
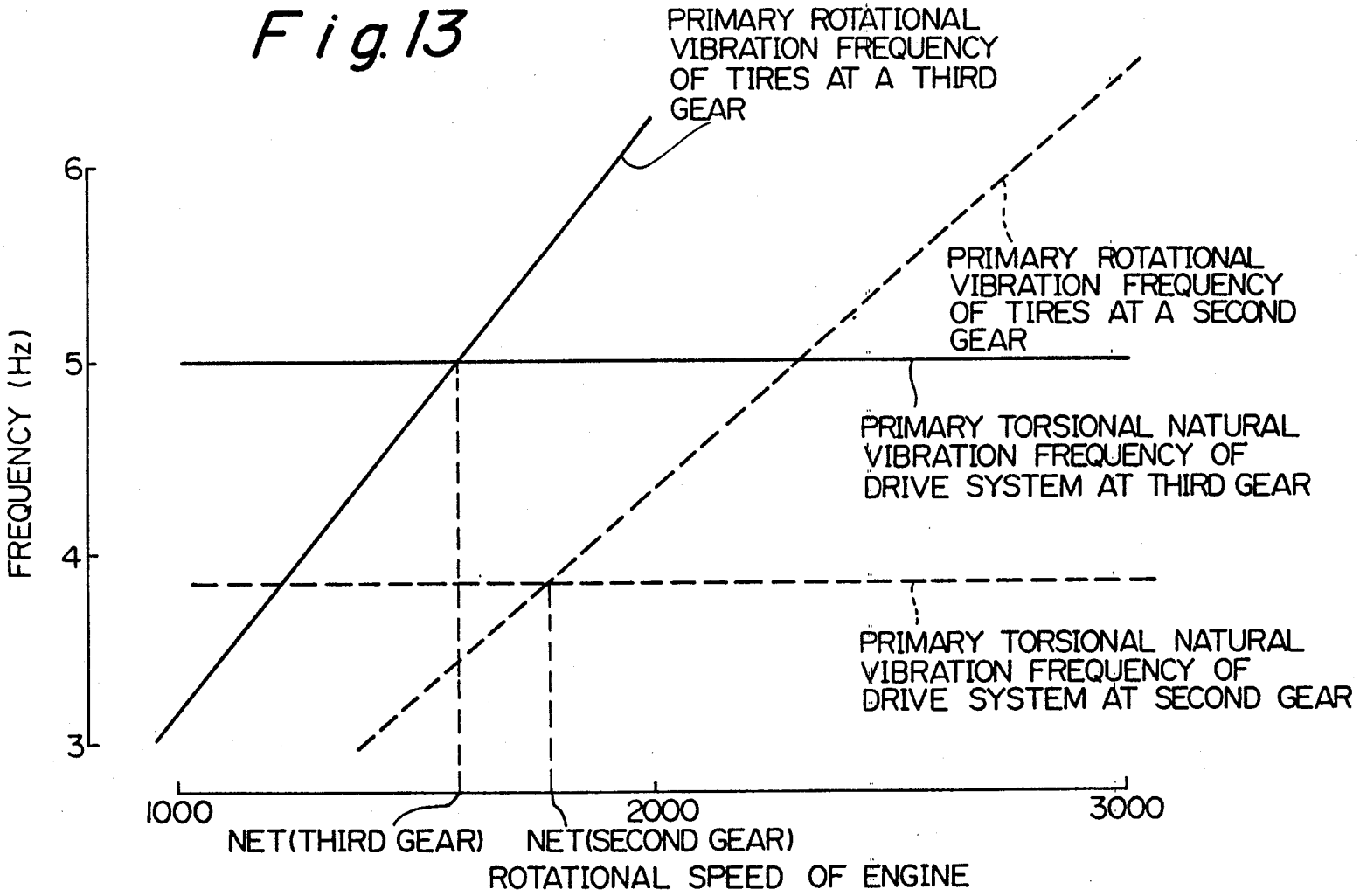
FIG. 13 is a graph explaining the relationship between the primary rotational vibration frequency in accordance with the gear position and the primary torsional natural vibration frequency of a drive system in accordance with the gear position.

In FIG. 13, a horizontal solid line shows the primary torsional natural vibration frequency of the drive system in third gear, a horizontal dash line shows the primary torsional natural vibration frequency of the drive system in second gear, a slant solid line shows the primary rotational vibration frequency of the tire in third gear, and a slant dash line shows the primary rotational vibration frequency of the tire in second gear. The intersection point of the horizontal solid line and the slant solid line shows the rotational speed Ne of the engine where $\phi T=\Phi$ at the third gear, and the intersection point of the horizontal dash line and the slant dash line shows the rotational speed Ne of the engine where $\phi T=\Phi$ in second gear.

Nevertheless, the point where $\phi T=\Phi$ usually is not actually the intersection point, because of wear in the tolerances of parts of the engine or deviations of the rotational speed of the engine, and accordingly, at step 1204 it is determined whether or not the calculated rotational speed Ne of the engine corresponding to $\phi T=\Phi$ is in the range of from $(NeT-\Delta N)$ to $(NeT+\Delta N)$ at step 1204, where $\Delta N$ is a predetermined margin value. If $(NeT-\Delta N)<Ne<(NeT+\Delta N)$, the control proceeds to step 1206, at which a flag XNERFV, indicating that the rotational speed Ne of the engine is still at the rotational speed NeT, is set to "1", but if $Ne\leqq(NeT-\Delta N)$ or $Ne\geqq(NeT+\Delta N)$, the control proceeds to step 1205, at which the flag XNERFV is set to "0". After step 1206, the control completes this routine, and after the step 1205, the control proceeds to step 901 and the operation explained in FIG. 9 is executed.

Figure 14A:
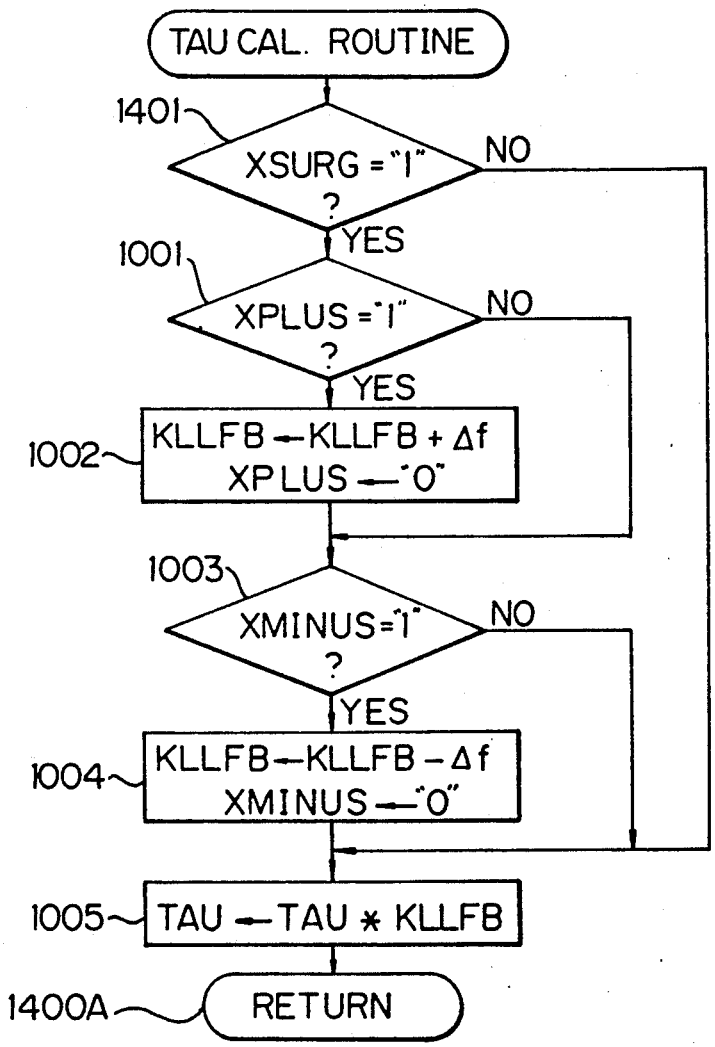

FIG. 14A is a modification of the flowchart shown in FIG. 10A. In FIG. 14A, step 1401 is added to steps 1001 to 1005 of FIG. 10A. At step 1401, it is determined whether or not the flag XSURG is equal to "1", and if XSURG="1", the control proceeds to step 1001. If XSURG≠"1", the control proceeds to step 1005, and the calculation of the fuel injection amount TAU using the flags XPLUS and XMINUS is carried out as explained in FIG. 10A. The routine of FIG. 14A is completed by step 1400A.

Therefore, according to the embodiment described above, the air-fuel ratio can be made leaner when surging is not occurring at the engine, and thus the emissions mainly NOx, are reduced. Accordingly, the air-fuel ratio can be preset on the lean side (the side at which surging easily occurs) when it is determined that the air-fuel ratio will be controlled to the rich side.

Note that the vibration period and the vibration amplitude of the vehicle due to variations of the cumbustion cycle are calculated in accordance with the output signal from the crank-angle sensor in the above-mentioned embodiment, but the vibration period and the vibration amplitude of the vehicle can be calculated from the output signal of an acceleration detecting sensor when mounted on the vehicle.

Figure 14B:
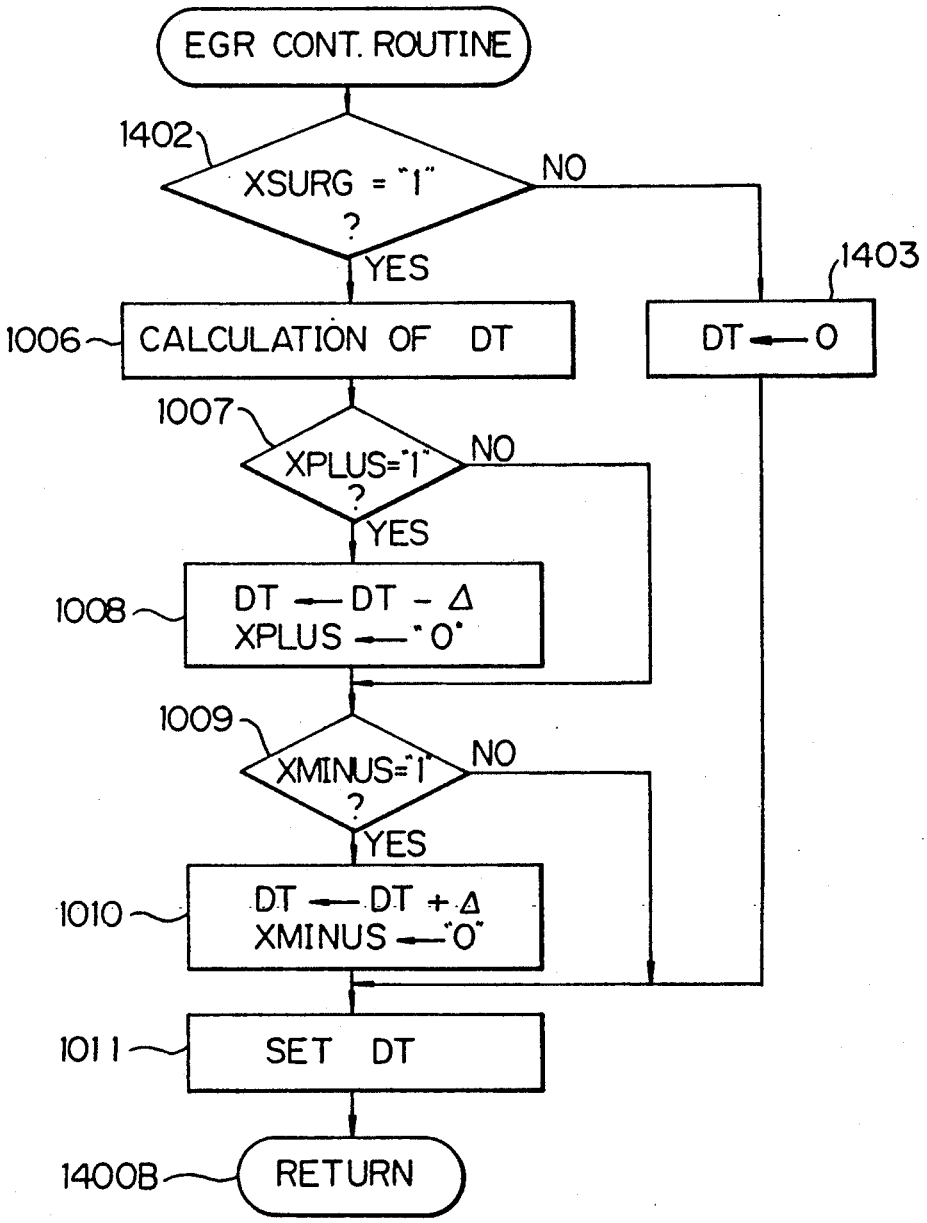

Further, the engine shown in FIG. 1 has a lean burning system, but if the present invention is applied to the engine having a stoichiometric air-fuel ratio control system, for example, as for an engine having an EGR system, it is possible to control the amount of EGR to reduce surging due to variations of the combustion cycle by stopping the control of the amount of EGR when the primary vibration period of the rotating tires is equal to the natural vibration. FIG. 14B is a modification of the flowcharts shown in FIG. 10B. In FIG. 14B, step 1402 and step 1403 are added to steps 1006 to 1011 of FIG. 10B. At step 1402, it is determined whether or not the flag XSURG is equal to "1", and if XSURG="1", the control proceeds to step 1006. If XSURG≠"1", the control proceeds to step 1403, at which the control of the amount of EGR is prohibited by setting the duty ratio to 0. At step 1006 to 1011, the decrement or increment of the amount of EGR by controlling the duty ratio DT of the electro-magnetic valve 20 is executed as explained in FIG. 10B. The routine of FIG. 14B is completed by step 1400B.

Furthermore, although the vibration period is used for reducing surging due to variations of the combustion cycle, a signal having a frequency having a period which is the same as the vibration period can be used.

Furthermore, the variation in the combustion cycle of the internal combustion engine and the vibration period and the vibration amplitude of the vehicle can be detected by a period and an amplitude of signals output from a well-known acceleration sensor mounted on the body of the vehicle.

I claim:

1. A method of preventing surging due to variations of a combustion cycle of an internal combustion engine of a vehicle, comprising the steps of:

detecting a vibration period and a vibration amplitude of said vehicle;

storing a natural vibration period in accordance with a drive condition of a transmission system of said vehicle;

determining whether or not said detected vibration amplitude is larger than a predetermined value;

determining whether or not said detected vibration period is equal to said natural vibration period in accordance with a driving condition underwhich said vibration period is detected;

determining that surging of said vehicle due to said variations of the combustion cycle of the engine is occurring when said detected vibration amplitude is larger than said predetermined value and said detected vibration period is equal to said natural vibration period, in accordance with a driving condition underwhich said vibration period is detected; and increasing the torque of said engine when surging due to said variations of the combustion of said engine is occurring.

2. A method as set forth in claim 1, further comprising the steps of:

determining whether or not said variations of the combustion cycle of the engine have lessened after the increment of the torque; and stopping the increment of the torque when it is determined that said variations of the combustion cycle of the engine have not lessened.

3. A method as set forth in claim 1, further comprising the steps of:

detecting a primary rotational vibration period of tires of said vehicle;

determining whether or not said detected primary rotational vibration period of said tires is equal to said natural vibration period of the transmission of said vehicle under a driving condition in which said primary rotational vibration period of said tires is detected; and inhibiting said torque control for preventing surging when said detected primary rotational vibration period of said tires is equal to said natural vibration period of the transmission of said vehicle under the driving condition in which said primary rotational vibration period of said tires is detected.

4. A method as set forth in claim 1, wherein said torque is increased by increasing an amount of fuel.

5. A method as set forth in claim 1, wherein said torque is increased by decreasing an amount of EGR.

6. A method as set forth in claim 1, wherein said vibration period of the vehicle and said vibration amplitude are detected in accordance with signals output by a crank-angle sensor.

7. A method as set forth in claim 6, further comprising the steps of:

detecting intervals of said signals output by said crank-angle sensor, by sampling;

storing maximum and minimum values of said intervals with the storing time;

calculating said vibration amplitude by subtracting said minimum value from said maximum value; and calculating said vibration period of the vehicle from the time at which said maximum and minimum values are stored.

8. A method of preventing surging due to variations of a combustion cycle of an interanl combustion engine of a vehicle, comprising the steps of:

detecting a vibration amplitude of said vehicle;

determining whether or not said detected vibration amplitude is larger than a predetermined value;

controlling a torque of said engine to reduce surging when said detected vibration amplitude is larger than said predetermined value;

storing a natural vibration period in accordance with a drive condition of a transmission system of said vehicle;

detecting a primary rotational vibration period of tires of said vehicle;

determining whether or not said detected primary rotational vibration period of said tires is equal to said natural vibration period of the transmission of said vehicle under a driving condition at which said primary rotational vibration period of said tires is detected; and inhibiting said torque control for preventing surging when said detected primary rotational vibration period of said tires is equal to said natural vibration period of the transmission of said vehicle under the driving condition at which said primary rotational vibration period of said tires is detected.

9. A method as set forth in claim 8, further comprising the steps of:

determining whether or not said surging has lessened after the control of the torque; and stopping the control of the torque when it is determined that said surging has not lessened.

10. A method as set forth in claim 8, wherein said torque is controlled by increasing or decreasing an amount of fuel.

11. A method as set forth in claim 8, wherein said torque is controlled by decreasing or increasing an amount of EGR.

12. A method as set forth in claim 8, wherein said vibration period of the vehicle and said vibration amplitude are detected in accordance with signals output by a crank-angle sensor.

13. A method as set forth in claim 12, further comprising the steps of:

detecting intervals of said signals output by said crank-angle sensor, by sampling;

storing maximum and minimum values of said intervals with the storing time;

calculating said vibration amplitude by subtracting said minimum value from said maximum value; and calculating said vibration period of the vehicle from the time at which said maximum and minimum values are stored.

14. An apparatus for preventing surging due to variations of a combustion cycle of an internal combustion engine of a vehicle, comprising:

means for detecting a vibration period and a vibration amplitude of said vehicle;

means for storing a natural vibration period in accordance with a drive condition of a transmission system of said vehicle;

means for determining whether or not said detected vibration amplitude is larger than a predetermined value;

means for determining whether or not said detected vibration period is equal to said natural vibration period in accordance with a driving condition under which said vibration period is detected;

means for determining that surging due to said variations of a combustion cycle of said engine is occurring at said vehicle when said detected vibration amplitude is larger than said predetermined value and said detected vibration period is equal to said natural vibration period in accordance with a driving condition under which said vibration period is detected; and means for increasing a torque of said engine when surging due to said variations of a combustion cycle of said engine is occurring.

15. An apparatus as set forth in claim 14, further comprising:

means for determining whether or not said variations of the combustion cycle of the engine have lessened after the increment of the torque; and means for stopping the increment of the torque when it is determined that said variations of the combustion cycle of the engine have not lessened.

16. An apparatus as set forth in claim 14, further comprising:

means for detecting a primary rotational vibration period of tires of said vehicle;

means for determining whether or not said detected primary rotational vibration period of said tires is equal to said natural vibration period of the transmission of said vehicle under a driving condition in which said primary rotational vibration period of said tires is detected; and means for inhibiting said torque control for preventing surging when said detected primary rotational vibration period of said tires is equal to said natural vibration period of the transmission of said vehicle under the driving condition in which said primary rotational vibration period of said tires is detected.

17. An apparatus as set forth in claim 14, wherein said torque is increased by increasing an amount of fuel.

18. An apparatus as set forth in claim 14, wherein said torque is increased by decreasing an amount of EGR.

19. An apparatus as set forth in claim 14, wherein said vibration period of the vehicle and said vibration amplitude are detected in accordance with signals output by a crank-angle sensor.

20. An apparatus as set forth in claim 19, further comprising:

means for detecting intervals of said signals output by said crank-angle sensor, by sampling;

means for storing maximum and minimum values of said intervals with the storing time;

means for calculating said vibration amplitude by subtracting said minimum value from said maximum value; and means for calculating said vibration period of the vehicle from the time at which said maximum and minimum values are stored.

21. An apparatus for preventing surging due to variations of a combustion cycle of an internal combustion engine of a vehicle, characterized in that said apparatus comprises:

means for detecting a vibration amplitude of said vehicle;

means for determining whether or not said detected vibration amplitude is larger than a predetermined value;

means for controlling a torque of said engine to reduce surging when said detected vibration amplitude is larger than said predetermined value;

means for storing a natural vibration period according to a drive condition of a transmission system of said vehicle;

means for detecting a primary rotational vibration period of tires of said vehicle;

means for determining whether or not said detected primary rotational vibration period of tires is equal to said natural vibration period of the transmission of said vehicle under a driving condition at which said primary rotational vibration period of said tires is detected; and means for inhibiting said torque control for preventing surging when said detected primary rotational vibration period of said tires is equal to said natural vibration period of the transmission of said vehicle under a driving condition at which said primary rotational vibration period of said tires is detected.

22. An apparatus as set forth in claim 21, further comprising:

means for determining whether or not said surging have lessened after the control of the torque; and means for stopping the control of the torque when it is determined that said surging has not lessened.

23. An apparatus as set forth in claim 21, wherein said torque is controlled by increasing or decreasing an amount of fuel.

24. An apparatus as set forth in claim 21, wherein said torque is controlled by decreasing or increasing an amount of EGR.

25. An apparatus as set forth in claim 21, wherein said vibration period of the vehicle and said vibration amplitude are detected in accordance with signals output by a crank-angle sensor.

26. An apparatus as set forth in claim 25, further comprising:

means for detecting intervals of said signals output by said crank-angle sensor, by sampling;

means for storing maximum and minimum values of said intervals with the storing time;

means for calculating said vibration amplitude by subtracting said minimum value from said maximum value; and means for calculating said vibration period of the vehicle from the time at which said maximum and minimum values are stored.

* * * * *

UNITED STATES PATENT AND TRADEMARK OFFICE

CERTIFICATE OF CORRECTION

PATENT NO. : 5,016,593

DATED : May 21, 1991

INVENTOR(S) : Toshio Takaoka

It is certified that error appears in the above-identified patent and that said Letters Patent is hereby corrected as shown below:

Column 1

Line 17, "an" should read --a--.

Line 33, replace "variations" with --variation--.

Line 51, add "e" after -- th--.

Line 67, replace "ture" with --true--.

Column 2

Line 17, replace "redude" with --reduce--.

Line 28, replace "cumbustion" with --combustion--.

Column 5

Line 12, replace "proceed" with --proceeds--.

Line 31, replace "countes" with --counts--.

Column 6

Line 6, replace "ositive" with --positive--.

Column 7

Line 20, replace "a" with --an--.

Line 30, replace "a" with --an--.

Lines 40, 42 and 44, replace "priviously" with --previously--.

Column 8

Line 67, "an" should read --a--.

Column 9

Line 62, add "to" after --proceeds--.

Column 10

Line 18, delete "the" (1st occurence).

Line 59, replace "reductuion" with --reduction--.

UNITED STATES PATENT AND TRADEMARK OFFICE

CERTIFICATE OF CORRECTION

PATENT NO. : 5,016,593

DATED : May 21, 1991

INVENTOR(S) : Toshio Takaoka

It is certified that error appears in the above-identified patent and that said Letters Patent is hereby corrected as shown below:

Column 11

Line 66, replace "descrived" with --described--.

Column Column 13

Line 4, replace "calculate" with --calculated--.
Line 8, delete "the" after --the--.
Line 18, replace "of" with --if--.

Column 15

Line 10, replace "underwhich" with --under which--.
Line 18, replace "underwhich" with --during which--.
Line 67, replace "interanl" with --internal--.

Column 18

Line 31, replace "have" with --has--.

Signed and Sealed this

Ninth Day of March, 1993

*Attest:*

STEPHEN G. KUNIN

*Attesting Officer*

*Acting Commissioner of Patents and Trademarks*